US011352831B2

(12) United States Patent
Zehner

(10) Patent No.: US 11,352,831 B2
(45) Date of Patent: Jun. 7, 2022

(54) GLASS SEAL TRACKING SPACER APPLICATOR

(71) Applicant: PDS IG Holding LLC, Prairie Du Sac, WI (US)

(72) Inventor: Kent Douglas Zehner, Mazomanie, WI (US)

(73) Assignee: PDS IG Holding LLC, Prairie Du Sac, WI (US)

( * ) Notice: Subject to any disclaimer, the term of this patent is extended or adjusted under 35 U.S.C. 154(b) by 0 days.

(21) Appl. No.: 16/881,511

(22) Filed: May 22, 2020

(65) Prior Publication Data

US 2020/0370361 A1 Nov. 26, 2020

Related U.S. Application Data

(60) Provisional application No. 62/852,777, filed on May 24, 2019.

(51) Int. Cl.
*E06B 3/673* (2006.01)

(52) U.S. Cl.
CPC ..... *E06B 3/6733* (2013.01); *E06B 3/67321* (2013.01); *E06B 2003/67378* (2013.01)

(58) Field of Classification Search
CPC ..... E06B 3/6733; E06B 2003/67378; E06B 3/67326
See application file for complete search history.

(56) References Cited

U.S. PATENT DOCUMENTS 3,023,864 A 3/1962 Mostoller et al.
4,536,182 A 8/1985 Tatin et al.
4,652,472 A 3/1987 Davies et al.
5,433,818 A 7/1995 Lee
5,574,651 A 11/1996 Bracy et al.
6,128,871 A 10/2000 Corey et al.
(Continued)

FOREIGN PATENT DOCUMENTS

EP 0301983 9/1990
EP 1650396 7/2009
(Continued)

OTHER PUBLICATIONS

"Allmetal Muntin Bars webpage," pp. 1-2, Mar. 27, 2015, http://www.allmetalinc.com/Components/MuntinBars/aspx (1 page).
(Continued)

*Primary Examiner* — Christopher T Schatz
(74) *Attorney, Agent, or Firm* — Pauly, DeVries Smith & Deffner LLC

(57) ABSTRACT

Various embodiments provide a method for applying a spacer to a planar substrate, comprising supplying the spacer to be adhered to the planar substrate; defining a first notch, a second notch, and a third notch in the spacer; applying an adhesive to the spacer; translating the spacer in a longitudinal direction; aligning a first end of the spacer with a first corner of the planar substrate; feeding the spacer and the planar substrate between a front carriage and a rear carriage along a longitudinal axis of an unadhered portion of the spacer while pressing the spacer against the planar substrate to adhere a portion of the spacer being pressed by the front carriage to the planar substrate, and rotating, with a six-axis robot, the planar sheet and adhered portion of spacer.

9 Claims, 27 Drawing Sheets

(56) References Cited

U.S. PATENT DOCUMENTS

| | | | | |
|---|---|---|---|---|
| 6,425,221 | B1 | 7/2002 | Reichert | |
| 6,536,182 | B2 | 3/2003 | France et al. | |
| 6,551,304 | B1 | 4/2003 | Whalen et al. | |
| 6,651,304 | B2 | 11/2003 | Khalfoun et al. | |
| 7,008,492 | B2 | 3/2006 | Lisec | |
| 7,076,927 | B2 | 7/2006 | Trpkovski | |
| 7,485,342 | B2 | 2/2009 | Kawamori | |
| 7,674,343 | B2 | 3/2010 | Kawamori | |
| 8,001,742 | B2 | 8/2011 | Grismer et al. | |
| 8,397,780 | B2 | 3/2013 | Vianello et al. | |
| 8,967,219 | B2 | 3/2015 | Nieminen et al. | |
| 9,309,714 | B2 | 4/2016 | Nieminen et al. | |
| 9,759,007 | B2 | 9/2017 | Trpkovski | |
| 10,233,690 | B2 | 3/2019 | Nieminen et al. | |
| 2007/0157544 | A1 | 7/2007 | Zurn et al. | |
| 2009/0120035 | A1 | 5/2009 | Trpkovski | |
| 2009/0120036 | A1 | 5/2009 | Trpkovski | |
| 2011/0104512 | A1 | 5/2011 | Rapp et al. | |
| 2014/0113098 | A1 | 4/2014 | Rapp et al. | |
| 2015/0354266 | A1* | 12/2015 | Donohue | E06B 3/67391 156/559 |
| 2016/0340960 | A1 | 11/2016 | Trpkovski | |
| 2019/0024441 | A1 | 1/2019 | Hervieux | |

FOREIGN PATENT DOCUMENTS

| | | |
|---|---|---|
| EP | 2862644 | 4/2015 |
| EP | 2549048 | 2/2016 |

OTHER PUBLICATIONS

"Collaborative Robots," QComp Technologies, Inc. webpage published at least as early as Aug. 3, 2020, URL <https://www.qcomp.com/collaborative-robots/> (8 pages).

"Erdman Unmanned Robotic IG Work Cell," Erdman Automation YouTube video uploaded Sep. 13, 2018 URL <https://www.youtube.com/watch?v=s3ZUNiGjedM> (2 pages).

"Non-Final Office Action," for U.S. Appl. No. 15/155,844, dated Dec. 29, 2016 (10 pages).

"Notice of Allowance," for U.S. Appl. No. 15/155,844 dated Apr. 21, 2017 (9 pages).

* cited by examiner

GLASS SEAL TRACKING SPACER APPLICATOR

This application claims the benefit of U.S. Provisional Application No. 62/852,777, filed May 24, 2019, the content of which is herein incorporated by reference in its entirety.

FIELD

Embodiments herein relate to systems and methods for applying a spacer to a pane of glass.

SUMMARY

In an embodiment, a method for applying a spacer to a planar substrate, is included, the method can include supplying the spacer to be adhered to the planar substrate, wherein the spacer comprises a first spacer corner, a second spacer corner, and a third spacer corner; applying an adhesive to the spacer; translating the spacer in a longitudinal direction; aligning a first end of the spacer with a first corner of the planar substrate; feeding the spacer and the planar substrate between a front carriage and a rear carriage along a longitudinal axis of an unadhered portion of the spacer while pressing the spacer against the planar substrate to adhere a portion of the spacer being pressed by the front carriage to the planar substrate, wherein a portion of the spacer between a first end and a first spacer corner and a portion of the planar substrate between the first corner and a second corner is fed between the front carriage and the rear carriage resulting in a first adhered portion of the spacer; rotating, with a six-axis robot, the planar substrate and the first adhered portion of the spacer to bend the spacer at the first spacer corner, wherein the first spacer corner is aligned with the second corner of the planar substrate; feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the first spacer corner and the second spacer corner and a portion of the planar substrate between the second corner and a third corner is fed between the front carriage and the rear carriage resulting in a second adhered portion of the spacer; rotating, with a six-axis robot, the planar substrate, the first adhered portion of the spacer, and the second adhered portion of the spacer to bend the spacer at the second spacer corner, wherein the second spacer corner is aligned with the third corner of the planar substrate; feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the second spacer corner and the third spacer corner and a portion of the planar substrate between the third corner and a fourth corner is fed between the front carriage and the rear carriage resulting in a third adhered portion of the spacer; rotating, with a six-axis robot, the planar substrate, the first adhered portion of the spacer, the second adhered portion of the spacer, and the third adhered portion of the spacer to bend the spacer at the third spacer corner, wherein the third spacer corner is aligned with the fourth corner of the planar substrate; and feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the third spacer corner and a second end of the spacer and a portion of the planar substrate between the fourth corner and the first corner is fed between the front carriage and the rear carriage resulting in a fourth adhered portion of the spacer.

In an embodiment, supplying the spacer to be adhered to the planar substrate, comprises: unwinding a length of spacer material from a spool of spacer material; straightening the length of spacer material that has been unwound from the spool; defining a first notch at the first spacer corner, a second notch at the second spacer corner, and a third notch at the spacer corner; and separating the length of spacer material from the remainder of the spacer material on the spool to form the spacer that has the first end and the second end, and that is equivalent in length to a final spacer perimeter.

In an embodiment, applying the adhesive to the spacer further includes applying the adhesive to a first side of the spacer and to a second side of the spacer.

In an embodiment, aligning the first end of the spacer with the first corner of the planar substrate results in the first end of the spacer being adjacent to or inset from the first corner of the planar substrate.

In an embodiment, rotating the planar substrate and an adhered portion of the spacer includes a rotation of 90°.

In an embodiment, applying the adhesive to the spacer at least partially overlaps in time with feeding the spacer and the planar substrate between the front carriage and the rear carriage.

In an embodiment, feeding the spacer and the planar substrate between the front carriage and the rear carriage includes moving the front carriage along the longitudinal axis of the unadhered portion of the spacer.

In an embodiment, feeding the spacer and the planar substrate between the front carriage and the rear carriage includes moving the planar substrate and spacer along the longitudinal axis of the unadhered portion of the spacer.

In an embodiment, at least one of the rotations of the planar substrate includes a translation and a rotation of the planar substrate.

In an embodiment, the translation of the planar substrate involves feeding the planar substrate between the front carriage and the rear carriage.

In an embodiment, a system for applying a spacer to a planar substrate, is included having a. a spacer preparation element configured to supply and prepare a spacer, b. an adhesive applicator, wherein the adhesive applicator is configured to apply an adhesive to the spacer, c. a transport mechanism configured to move the spacer in a longitudinal direction, d. a spacer application element, can include a front carriage and a rear carriage, wherein the front carriage and rear carriage define a gap, wherein the gap is configured to allow a portion of the spacer and a portion of the planar substrate to be fed between the front carriage and rear carriage, wherein the front carriage is configured to press the spacer against the planar substrate that is fed through the gap to apply the spacer to the planar substrate, and e. a six-axis robot configured to retain the planar substrate, to rotate the planar substrate and to move the planar substrate in the longitudinal direction, wherein the six-axis robot translates the planar substrate in the longitudinal direction at the same speed at which the transport mechanism moves the spacer.

In an embodiment, the front carriage is configured to move in the opposite direction that the six-axis robot translates the planar substrate in while compressing the spacer and the planar substrate.

In an embodiment, the front carriage and rear carriage are in a fixed location.

In an embodiment, the front carriage includes a horizontal roller and a vertical roller.

In an embodiment, the rear carriage includes a horizontal roller.

In an embodiment, the front carriage is configured to contact the spacer and the rear carriage is configured to contact a back surface of the planar substrate opposite from the spacer.

In an embodiment, the vertical roller and the horizontal roller are arranged such that an axis of rotation of the vertical roller is perpendicular to an axis of rotation of the horizontal roller.

In an embodiment, the system is configured to apply a spacer to a planar substrate that has an outer perimeter of up to 50 feet.

In an embodiment, the transport mechanism includes a conveyor belt.

In an embodiment, a method for applying a spacer to a planar substrate, is included, the method can include a. unwinding a length of spacer material from a spool of spacer material, b. straightening the length of spacer material that has been unwound from the spool, c. defining a first notch, a second notch, and a third notch in the length of spacer material, d. separating the length of spacer material from the remainder of the spacer material on the spool to form the spacer that has a first end and a second end, e. applying an adhesive to a first side and a second side of the spacer, f. translating the spacer in a longitudinal direction, g. aligning a first end of the spacer with a first corner of the planar substrate, h. feeding the spacer and the planar substrate between a front carriage and a rear carriage along a longitudinal axis of an unadhered portion of the spacer while pressing the spacer against the planar substrate to adhere a portion of the spacer being pressed by the front carriage to the planar substrate, wherein a portion of the spacer between a first end and the first notch and a portion of the planar substrate between the first corner and a second corner is fed between the front carriage and the rear carriage resulting in a first adhered portion of the spacer, i. rotating, with a six-axis robot, the planar substrate and the first adhered portion of the spacer 90° to bend the spacer at the first notch, wherein the first notch is aligned with the second corner of the planar substrate, j. feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the first notch and the second notch and a portion of the planar substrate between the second corner and a third corner is fed between the front carriage and the rear carriage resulting in a second adhered portion of the spacer, k. rotating, with a six-axis robot, the planar substrate, the first adhered portion of the spacer, and the second adhered portion of the spacer 90° to bend the spacer at the second notch, wherein the second notch is aligned with the third corner of the planar substrate, l. feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the second notch and the third notch and a portion of the planar substrate between the third corner and a fourth corner is fed between the front carriage and the rear carriage resulting in a third adhered portion of the spacer, m. rotating, with a six-axis robot, the planar substrate, the first adhered portion of the spacer, the second adhered portion of the spacer, and the third adhered portion of the spacer 90° to bend the spacer at the third notch, wherein the third notch is aligned with the fourth corner of the planar substrate, and n. feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the third notch and a second end of the spacer and a portion of the planar substrate between the fourth corner and the first corner is fed between the front carriage and the rear carriage resulting in a fourth adhered portion of the spacer.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures (FIGS.), in which.

While embodiments are susceptible to various modifications and alternative forms, specifics thereof have been shown by way of example and drawings, and will be described in detail. It should be understood, however, that the scope herein is not limited to the particular aspects described. On the contrary, the intention is to cover modifications, equivalents, and alternatives falling within the spirit and scope herein.

DETAILED DESCRIPTION

Many window assemblies or insulating glass units can include a first sheet or pane of glass, a second sheet or pane of glass, and a spacer that separates the first sheet and second sheet. During the manufacturing process of the window assembly, the spacer can be formed into a spacer frame having the same shape as the perimeter of the window assembly, such as a rectangle, a triangle, a trapezoid, other polygons, archtop, doghouse, or other irregular shapes. In many examples, the spacer can be unwound from a spool of spacer material and cut to the desired length. The spacer can also have one or more notches cut into the spacer, such as to allow for a corner or a bend to be formed in the spacer. The spacer can have an adhesive or sealant applied to two opposite sides of the spacer, such as to adhere the spacer to the two sheets.

Described herein are various systems and methods for applying a spacer to a planar substrate of a window assembly or insulated glass unit (IGU). Various embodiments disclosed herein can provide a system or method which can quickly and accurately apply a spacer to the planar substrate. Various embodiments provide reduced assembly times and a smaller footprint than present systems and methods that are used to apply a spacer to a planar substrate. In some embodiments, a portion of the spacer can be applied or adhered to the planar substrate while another portion of the spacer, such as the opposite end, is still being prepared, which can result in the system requiring a smaller footprint.

Figure 1:
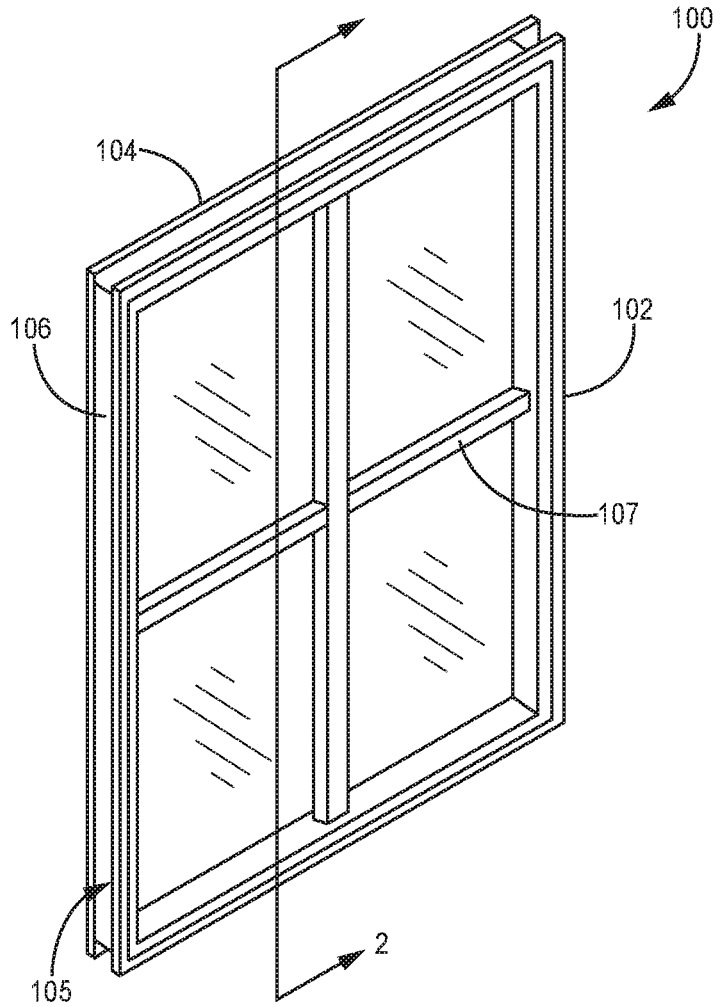
FIG. 1 is a perspective view of a window assembly including a muntin bar grid in accordance with various embodiments herein.
Figure 2:
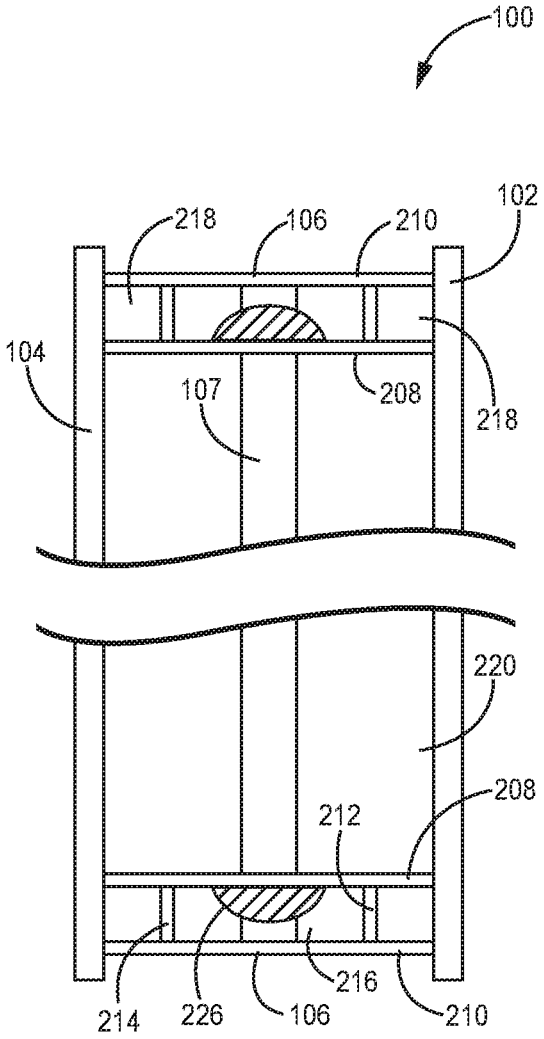
FIG. 2 is a cross-sectional view of the window assembly of FIG. 1 in accordance with various embodiments herein.

FIG. 1 shows a perspective view of a window assembly 100, according to some embodiments. FIG. 2 shows a cross-section view of the window assembly 100 along line 2-2 in FIG. 1. The window assembly 100 can include a first planar substrate and a second planar substrate, or a first sheet 102 and a second sheet 104. The window assembly 100 can include a spacer 106 disposed between the first sheet 102 and the second sheet 104. In some embodiments, the spacer 106 is slightly inset from the outer perimeter of the first sheet 102 and the second sheet 104. In various embodiments, the spacer 106 can be adhered to an inner surface of the first sheet 102 and an inner surface of the second sheet 104. The inner surfaces of the first sheet 102 and the second sheet 104 can face each other. In various embodiments, the window assembly 100 can include a frame that extends around the perimeter of the first sheet 102 and the second sheet 104. The frame is not shown in FIG. 1.

The first sheet 102 and the second sheet 104 can include a translucent, transparent, or semi-transparent material, such as to allow light to pass through the two sheets 102, 104 or to allow a person to see through the two sheets 102, 104. In various embodiments, the first sheet 102 and the second sheet 104 include glass, such as a clear glass. In various embodiments, the first sheet 102 and the second sheet 104 can be similar, such that the two sheets 102, 104 have a substantially similar shape and/or size.

The spacer 106 can be coupled to or adhered to the first sheet 102 and the second sheet 104. The spacer 106 can extend from the first sheet 102 to the second sheet 104, such as to define a volume 220. The volume 220 is shown in FIG. 2, which is a cross-sectional view of the window assembly of FIG. 1 in accordance with some embodiments. The volume 220 is defined between the first sheet 102 and the second sheet 104. The spacer 106 also forms a boundary of the volume 220.

The spacer 106 is formed into a spacer frame 105 that surrounds the volume 220. The spacer frame 105 has a shape that matches the outer perimeter shape of the window assembly 100. For example, where the window assembly 100 is rectangular as in FIG. 1, the spacer frame 105 is a rectangle. In other embodiments, the window assembly 100 can be a different shape, such as mentioned before. In various embodiments, the spacer 106 can be formed into a square, a rectangle, a triangle, a trapezoid, a polygon, a regular polygon, a doghouse shape, or an irregular shape such as an archtop.

In various embodiments, the window assembly 100 can include one or more muntin bars 107. One or more muntin bars 107 can be disposed within the window, such as between the first sheet and the second sheet. Muntin bars 107 can be included in a window assembly, such as to increase the aesthetic appeal. In some window assemblies the muntin bars can be arranged in a grid, such as a one by one grid as shown in FIG. 1, including one vertical muntin bar and one horizontal muntin bar. The muntin bars 107 can be disposed within the volume 220 defined by the first sheet 102, the second sheet 104 and the spacer 106. The muntin bars 107 can have a first end and a second end. The first end and second end can be coupled to opposite portions of the spacer 106, such that the muntin bar 107 can extend across the window assembly 100.

Figure 3:
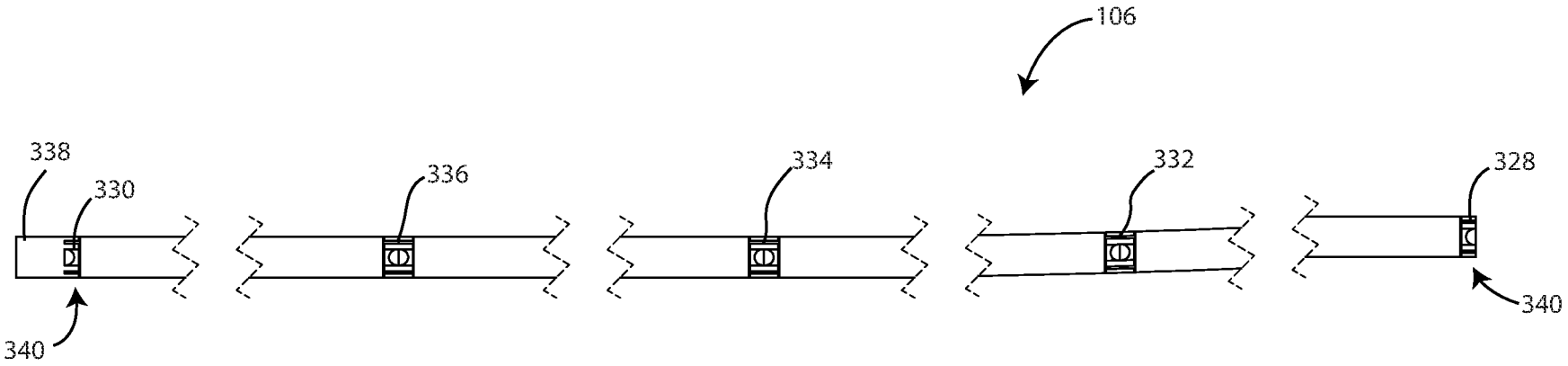
FIG. 3 is a top view of a spacer in accordance with various embodiments herein.
Figure 4:
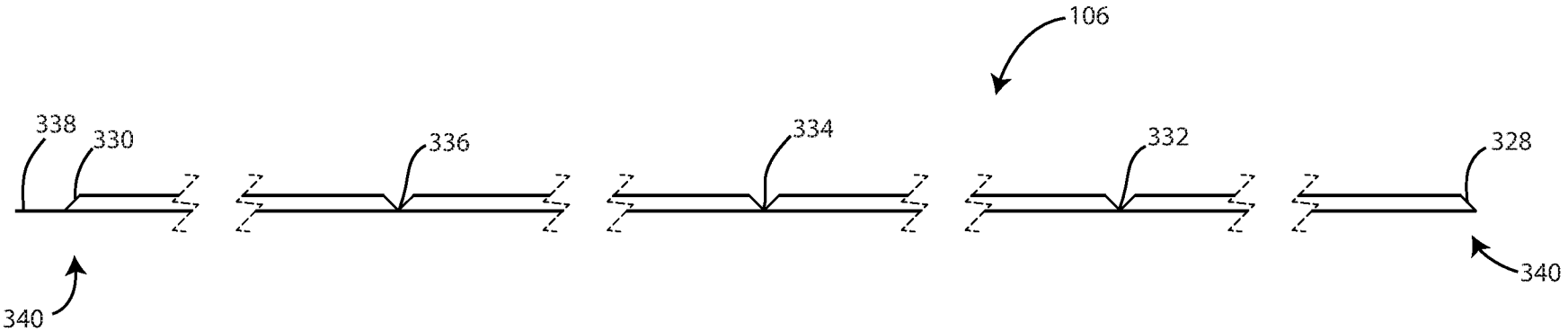
FIG. 4 is a front view of a spacer in accordance with various embodiments herein.

The spacer 106 shown in FIGS. 2-4 are examples of spacers that can be applied using the systems and methods described herein. It should be understood that other spacer shapes and configurations could also be used.

In some embodiments, the spacer 106 can include a first elongated strip 208, a second elongated strip 210, a first lateral side wall 212, and a second lateral side wall 214. The spacer 106 can define an interior space 216. In various embodiments, the interior space 216 can be at least partially occupied by a filler 226, where the filler 226 includes a desiccant. The purpose of the desiccant is to absorb moisture from the gas within the interior space 216 of the window assembly 100 in order to reduce or eliminate fogging on the interior surfaces of the first sheet 102 and second sheet 104.

The filler 226 provides a structure for retaining desiccant within the interior space 216 of the spacer 106. As a result, there is not a need for loose beaded desiccant positioned in the spacer in many embodiments. In other spacers, it is common to have loose beaded desiccant positioned within the spacer.

The filler 226 is generally configured to contain/hold a desiccant material. The filler 226 can be a variety of materials and combinations of materials. In a variety of embodiments, the filler 226 holds its form and does not break apart easily. The filler 226 can generally be any type of adhesive material. As used herein, the term "adhesive material" is defined as any material that chemically hardens and is from natural or synthetic origins. Examples of synthetic substrates are acrylics, silicones, urethanes, etc. Examples of natural substrates include starches, collagen, natural resin, and the like.

The filler 226 can include a matrix material and can have a desiccant disposed within. Examples of matrix desiccants include those manufactured by W.R. Grace & Co. based in Columbia, Md. and H.B. Fuller Company based in Saint Paul, Minn. One particular example matrix material is HL-5157 produced by H.B. Fuller Company. In some embodiments, the filler 226 can incorporate beaded desiccant within or attached to the filler 226. One example is described in "SPACER HAVING A DESICCANT", U.S. 2014/0113098, filed on Oct. 21, 2013.

In a variety of embodiments, the filler 226 is also configured to provide an increased surface area exposed to the atmosphere compared to the surface area in contact with a strip of a spacer. As such, the surface area of the filler 226 in contact with the elongate strip is less than the surface area of the filler 226 that is not in contact with the elongate strip. The filler 226 can be a variety of shapes, although it is depicted in the Figures as having a semi-circle cross-section. In one alternate example, the filler has a tubular cross section. Those having skill in the art will appreciate that other shapes can also be used.

In some embodiments, the first elongated strip 208 can define one or more breather holes, such as small apertures in the first elongated strip 208 that can allow gas to pass from the volume 220 between the first sheet 102 and the second sheet 104 into the interior space 216, where the gas can come into contact with the filler 226. It is also possible for gas from the volume 220 to pass into the interior space 216 through other openings, such as corner notches or muntin openings, which are further described herein.

In some embodiments of the spacer 106, the first elongated strip 208 can be parallel with the second elongated strip 210. In some embodiments, the first lateral side wall 212 can be parallel with the second lateral side wall 214. In some embodiments, the first elongated strip 208 and the second elongated strip 210 can be perpendicular to the first lateral side wall 212 and the second lateral side wall 214.

In various embodiments, the lateral side walls 212, 214 can be recessed from the edge of the first elongated strip 208 and the second elongated strip 210, such as to define an exterior space 218 along elongate edges of the spacer 106. The exterior space 218 can be separated from the interior space 216 of the spacer 106 by the lateral side walls 212, 214. In various embodiments, the exterior space 218 can be further bounded and defined by the first sheet 102 or the second sheet 104. In some embodiments, the exterior space 218 can be at least partially or completely filled with an adhesive or sealant, such as to adhere the spacer 106 to the first sheet 102 and/or the second sheet 104, and to adhere the first sheet 102 to the second sheet 104.

FIG. 3 shows a top view of a spacer 106 in accordance with various embodiments herein. FIG. 4 shows a front view of the spacer 106 from FIG. 3. In various embodiments, the spacer 106 can have a plurality of notches 332, 334, 336 cut into the spacer 106. The number of notches can be equivalent to the number of corners the spacer 106 will be bent at. The spacer 106 can be bent at each of the notches, such as to form the spacer frame 105. In some embodiments, the locations of the notches 332, 334, 336 can be the location of spacer corners. Spacer corners are can be portions of the spacer 106 that can be intended to be corners of the spacer frame. In some embodiments, the spacer corners are substantially the same the majority of the remainder of the spacer 106. In some embodiments, the spacer corners can be marked, such as to have a visual indication as to where the spacer 106 will be bent. In some embodiments, the notches 332, 334, 336 can be defined at the spacer corners.

In some embodiments, the spacer 106 does not include a plurality of notches. In some embodiments, the system can be configured to bend the spacer at the corners without a notch, such as that an outer portion of the spacer 106 can be in tension, while an inner portion of the spacer 106 is in compression. In some embodiments, the system does not need to align notches with corners of the sheet 102, since a corner can be bent in any portion of the spacer 106.

In various embodiments, the spacer 106 can include a first end 328 and a second end 330. The first end 328 and the second end 330 can be configured to mate with each other to form a closed loop for the spacer frame 105. In some embodiments, the second end 330 can include a tail 338, such as a portion of the first elongated strip 208 that extends beyond the remainder of the spacer 106.

In various embodiments, the spacer 106 can include one or more notches 332, 334, 336, such as to facilitate bending the spacer 106 into the spacer frame 105. In some embodiments, the spacer 106 can include a first notch 332, a second notch 334, and a third notch 336. The notches 332, 334, 336 can be disposed between the two ends 328, 330. In some embodiments, the first end 328 can include half of a fourth notch 340 and the second end 330 can include the second half of the fourth notch 340, such that the first end 328 can mate with the second end 330 at a corner of the spacer frame 105 that aligns with a corner of the first sheet 102 and/or second sheet 104. In some embodiments, the distance between first end 328 and first notch 332 is equivalent to the distance between the second notch 334 and the third notch 336, and the distance between the first notch 332 and the second notch 334 is equivalent to the distance between the third notch 336 and the second end 330.

Figure 5:
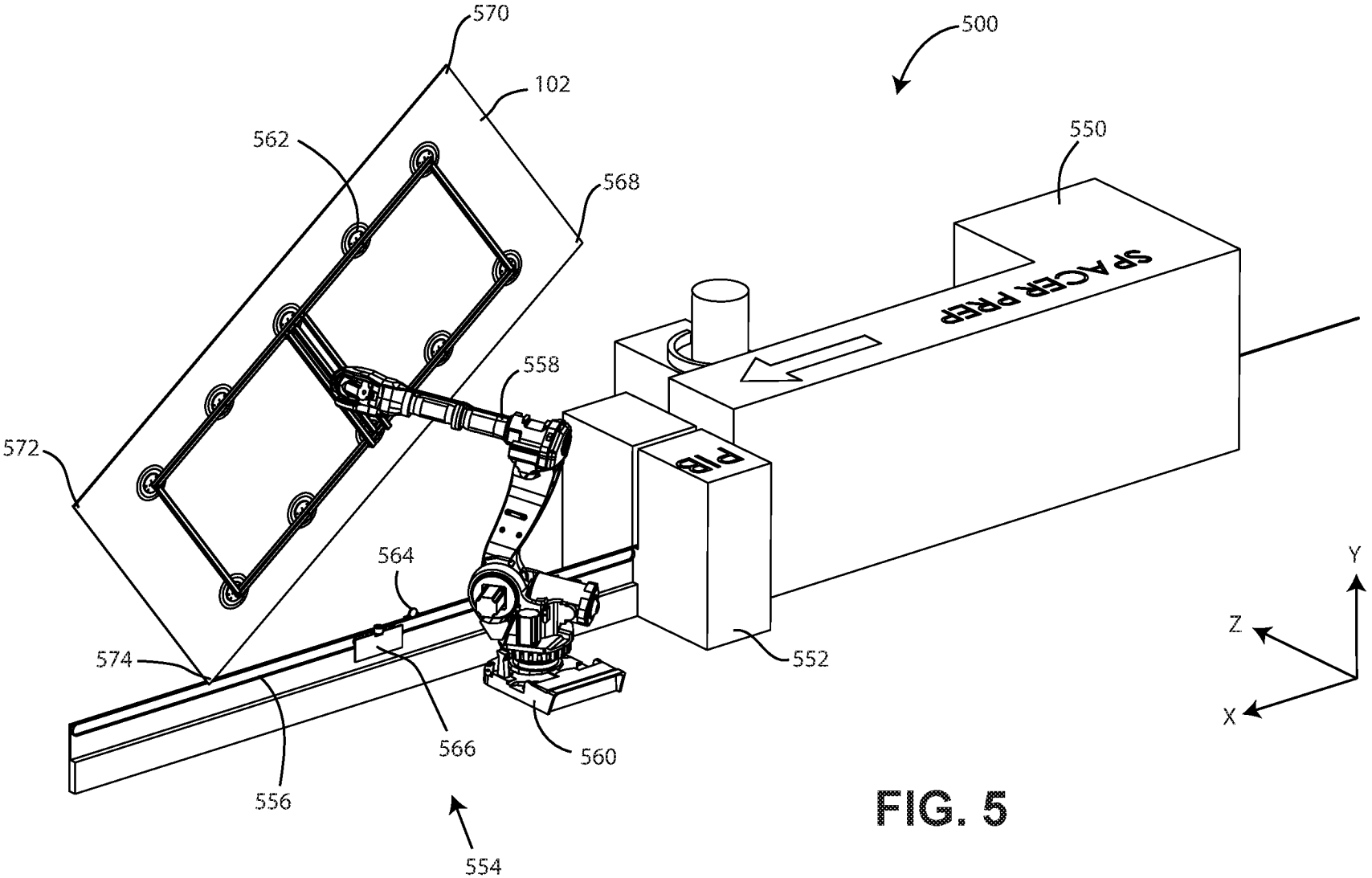
FIG. 5 is a perspective view of a system for applying a spacer in accordance with various embodiments herein.

FIG. 5 shows a perspective view of a system 500 for applying a spacer 106 to a sheet 102, 104 in accordance with various embodiments herein. FIG. 5 also shows the x-axis, y-axis, and z-axis. The arrows of the axes point in what will be referred to as the positive direction along the given axis.

In various embodiments, the system 500 can be configured to apply a spacer 106 to a sheet 102. In some embodiments, system 500 can be configured to accept a planar substrate or sheet 102 that can be up to 2.5 meters tall, 5 meters long, and weigh about 380 kilograms.

The system 500 can include a spacer preparation element 550, an adhesive application element 552, and a spacer application element 554. In various embodiments, a transport mechanism 556 can move the spacer 106 through one or more of the elements in the system 500. The transport mechanism 556 can be configured to move the spacer 106 in a longitudinal direction. In the figures, the longitudinal direction is in the X direction. In some embodiments, the transport mechanism 556 can include a conveyor, such a conveyor belt or motorized rollers.

In some embodiments, a portion of the spacer 106 can still be within the spacer preparation element 550 while the first end of the spacer 106 is being adhered to the sheet 102. The footprint of the system 500 can be greatly reduced as a result of the second end of the spacer still being prepared while the first end of the spacer is being applied, because the footprint of the system does need not extend to a length equivalent to the length of the unbent spacer 106.

Spacer Preparation

The spacer preparation element 550 can prepare a spacer 106 to be applied to a sheet 102. The spacer preparation element 550 can cut, trim, or otherwise define the one or more notches into the spacer 106. The spacer preparation element 550 can cut the spacer 106 to a desired length, such as to separate the spacer 106 from a stock or reel of spacer material. In some embodiments, the spacer preparation element 550 can unwind and/or straighten a spacer 106. In various embodiments, once the spacer 106 leaves the spacer preparation element 550, the spacer 106 can proceed into the adhesive application element 552. In some embodiments, the spacer preparation element 550 can alter, form, or prepare the spacer 106 to receive one or more muntin bars or SDL ("simulated divided lites") bars.

Adhesive Application

The adhesive application element 552 can apply an adhesive or sealant to the spacer 106. In some embodiments, the system can include a spacer 106 that has already been prepared with a sealant or adhesive prior. In some embodiments, the adhesive or sealant can be applied to two sides of the spacer 106, such as the two sides of the spacer 106 that will face the first sheet 102 and the second sheet 104. In some embodiments, the adhesive or sealant can be applied to the exterior spaces 218 of the spacer 106 as discussed above. The adhesive application element 552 can extrude the adhesive at a constant rate onto the spacer 106. In some embodiments, the spacer 106 can move in the +X direction at about 200 mm/s. In some embodiments, the spacer 106 can move in the +X direction at a speed of at least 50 mm/s and not more than 1500 mm/s.

In various embodiments, the adhesive or sealant can include polyisobutylene (PIB), butyl, curable PIB, hot melt silicon, acrylic adhesive, acrylic sealant, and other Dual Seal Equivalent (DSE) type materials.

Spacer Application

Figure 9:
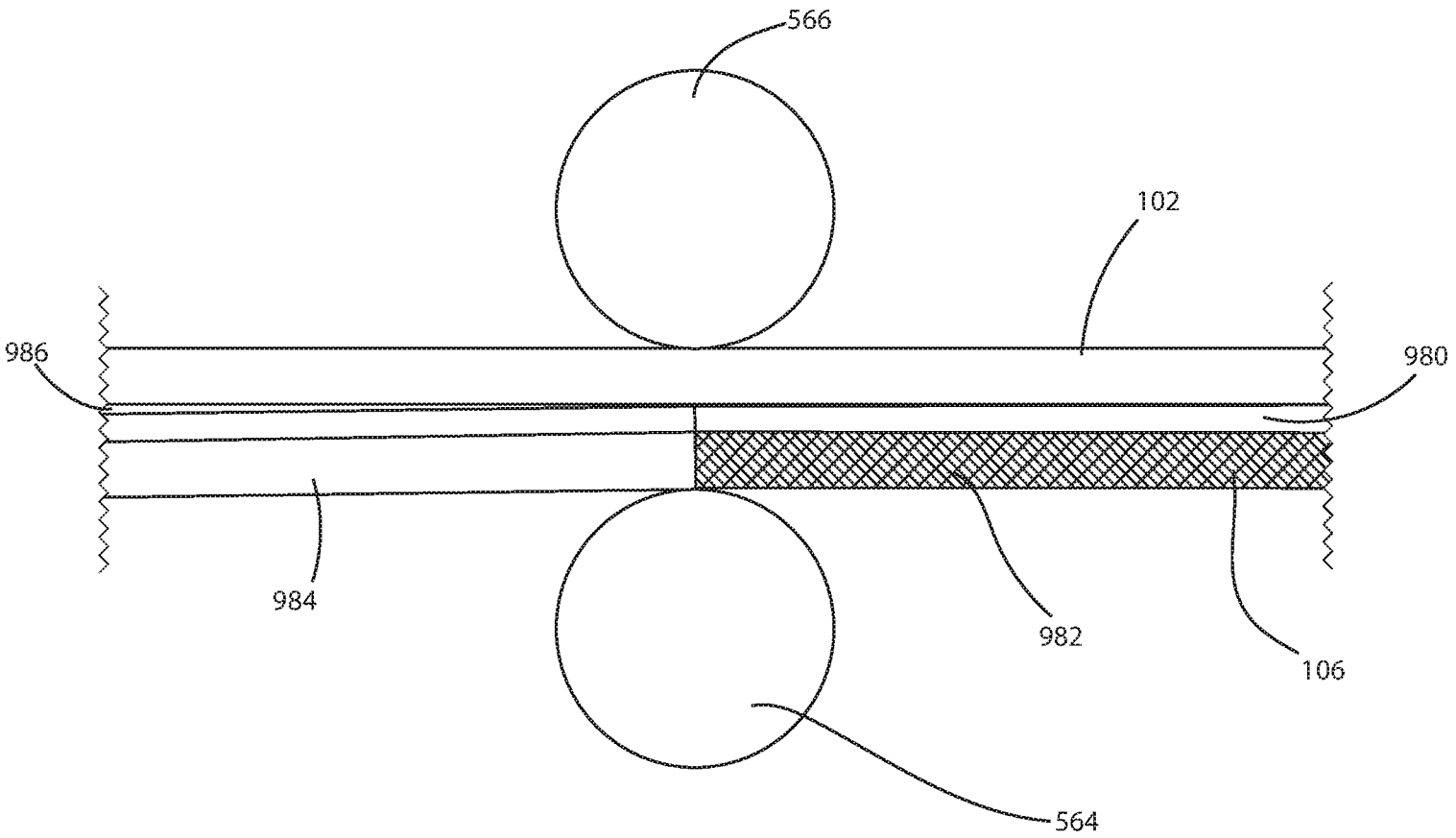
FIG. 9 is a schematic of a portion of the planar substrate and spacer being fed through the front carriage and rear carriage in accordance with various embodiment herein.

Various embodiments provide a spacer application element 554 for applying a spacer 106 to a sheet 102. The spacer application element 554 can include a front carriage 564 and a rear carriage 566. The front carriage 564 and rear carriage 566 can define a gap. The gap is configured to allow a portion of the spacer 106 and a portion of the sheet 102 to be fed between the front carriage 564 and rear carriage 566, such as shown in FIG. 9. The spacer 106 and the planar substrate 102 that is fed through the gap can be compressed to apply the spacer to the planar substrate, such as the front carriage 564 contacting the spacer 106 to apply the spacer 106 to a surface of the sheet 102 and the rear carriage 566 contacting an opposite surface of the sheet 102.

The spacer application element 554 can include a six-axis robot 558 configured to retain the sheet 102, to rotate the sheet 102 and to move the sheet 102 in the longitudinal direction. The six-axis robot 558 can translate the sheet 102 in the longitudinal direction at the same speed at which the transport mechanism 556 moves the spacer 106 in the longitudinal direction.

The spacer application element 554 can apply or adhere a spacer 106 to a sheet 102. In some embodiments, the spacer application element 554 can include a robot 558. The robot 558 can move the sheet 102, such as to lift, lower, rotate, or translate the sheet 102. In various embodiments, the robot 558 can combine two motions, such as a rotation and a translation. In some embodiments, the robot 558 can include a six-axis robot, such as able to translate and rotate about the X-axis, the Y-axis, and the Z-axis. In some embodiments, the robot 558 can include a base 560. In some embodiments, the base 560 can be mounted on rails (not shown), such as to translate the robot 558 along the x-axis or the longitudinal direction, such as to provide a seven-axis robot. In some embodiments, the robot 558 can include one or more vacuum elements 562 configured to temporarily couple the sheet 102 to the robot 558.

In some embodiments, the spacer application element 554 can include a front carriage 564 and/or a rear carriage 566. In various embodiments, the sheet 102 can be positioned between the front carriage 564 and the rear carriage 566 while a spacer 106 is applied to the sheet 102. In various embodiments, the spacer 106 being applied to the sheet 102 can be disposed between the front carriage 564 and the sheet 102.

The steps that the system 500 performs to apply the spacer 106 to the sheet 102 are shown in FIGS. 6, 11, and 14-16. The spacer 106 can exit the adhesive application element 552 and enter the spacer application element 554. Upon entering the spacer application element 554, the system 500 can know the size of the sheet 102, the size of the spacer 106, when and where the spacer 106 is located at all times, and the position of the sheet 102 in reference to the center of rotation of the robot 558. In some embodiments, this information can be read by the system, such as a barcode the includes size information. In some embodiments, this information can be sensed or measured using sensors. In some embodiments, some of this information can be read, and other information can be sensed or measured.

The sheet 102 can include a first corner 568, a second corner 570, a third corner 572 and a fourth corner 574. While the figures depict the sheet 102 as a rectangle, it should be understood that other shapes, some that include more than four corners, are also within the scope of this disclosure.

In some embodiments, the system 500 can apply the first notch 332 at the second corner 570, the second notch 334 at the third corner 572, and the third notch 336 at the fourth corner 574. The first and second ends 328, 330, as well as the fourth notch 340, can be applied at the first corner 568. In some embodiments, the system 500 can start by aligning the first end 328 with the first corner 568, such as shown in FIGS. 6-8 and 11.

Figure 6:
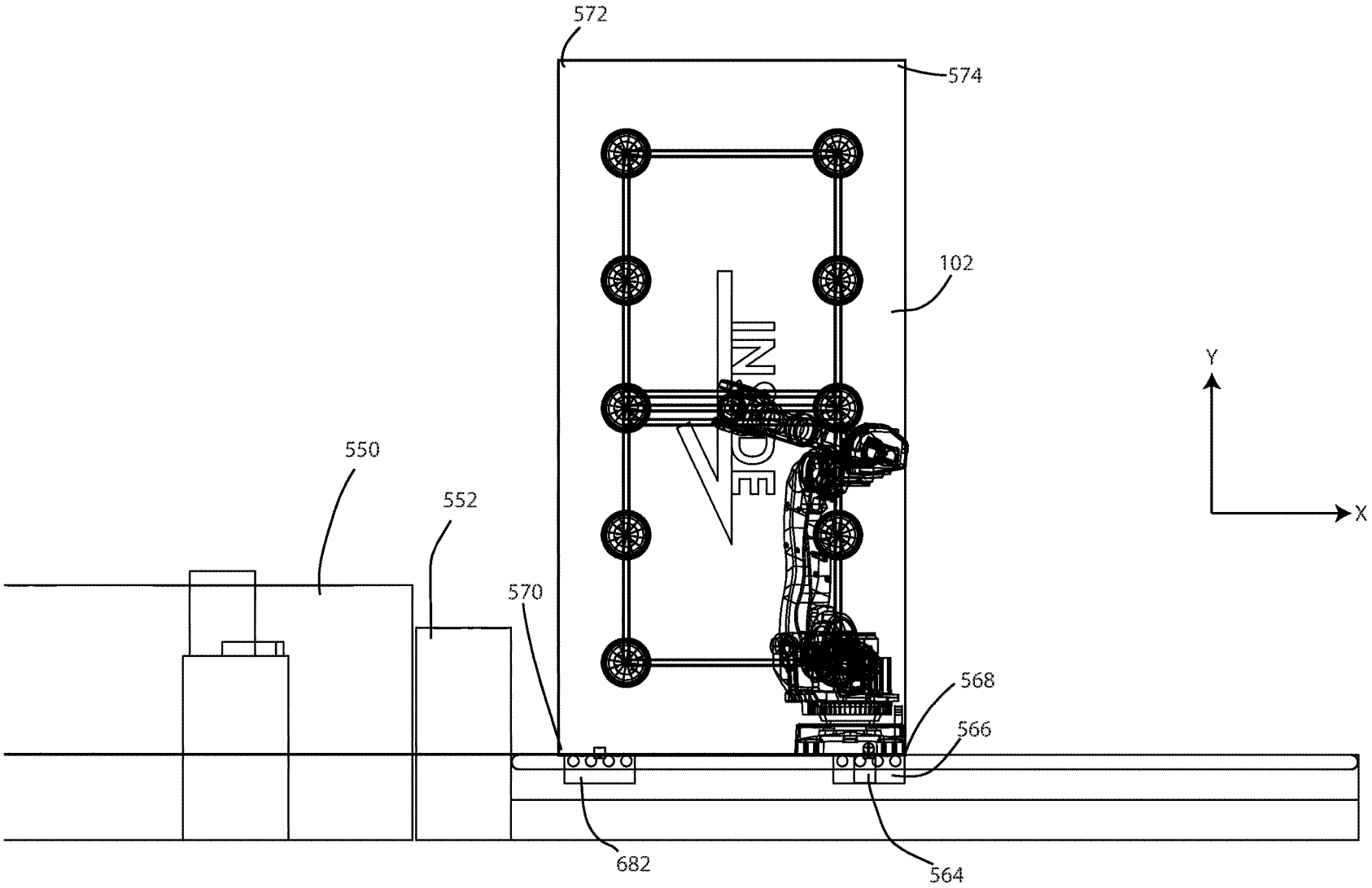
FIG. 6 is a front view of a system for applying a spacer in accordance with various embodiments herein.
Figure 7:
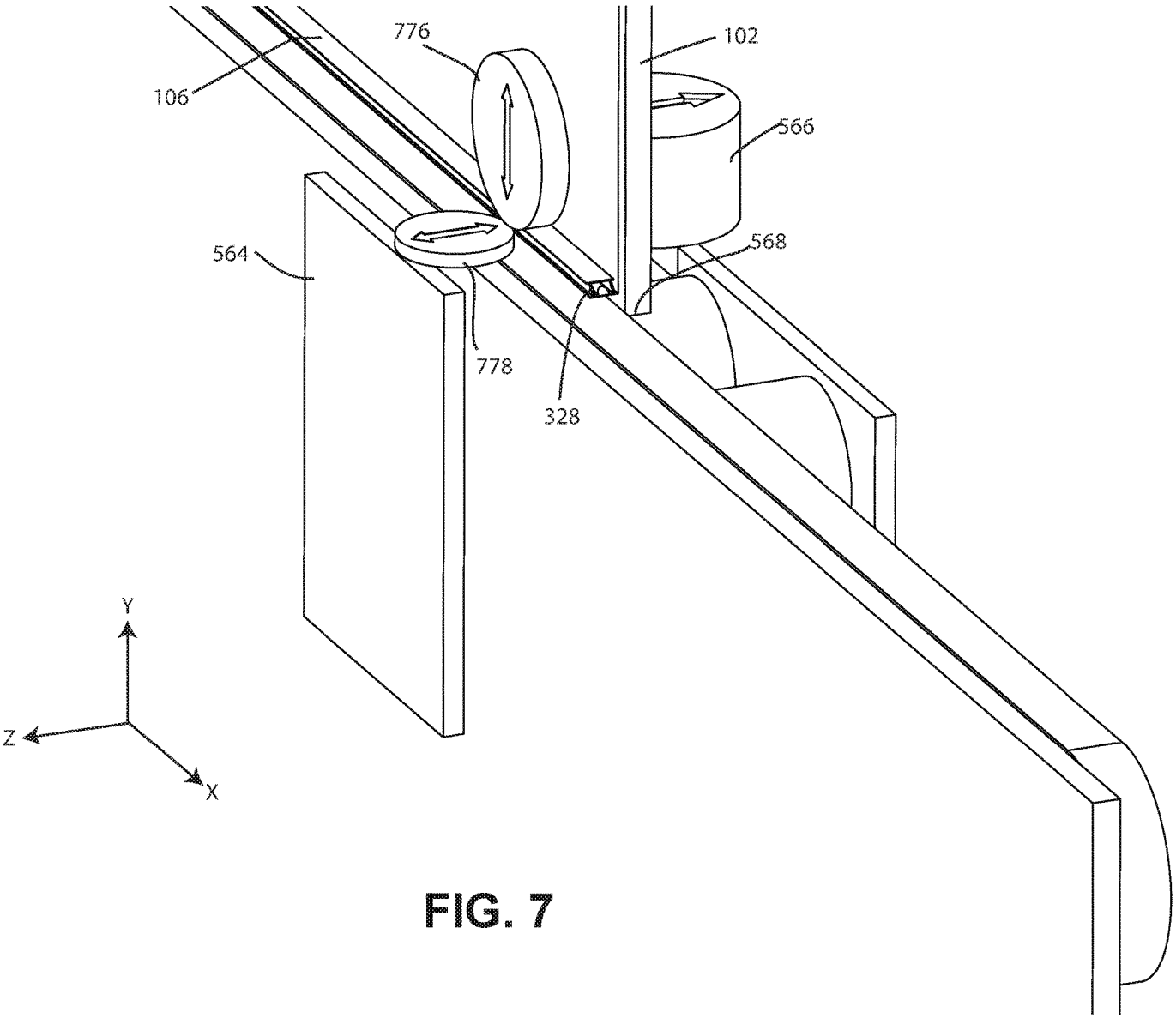
FIG. 7 is a perspective view of a portion of a system for applying a spacer in accordance with various embodiments herein.
Figure 8:
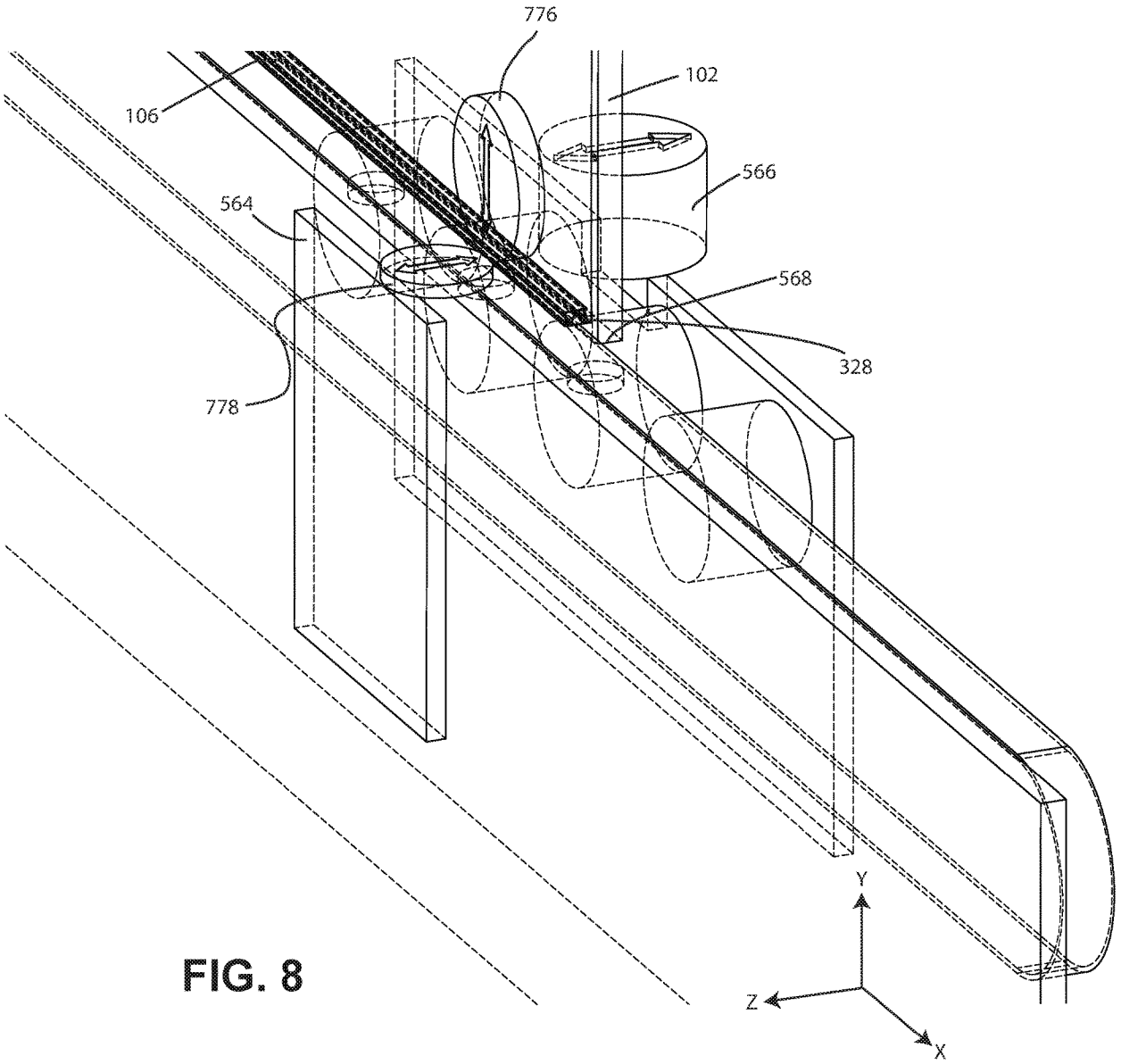
FIG. 8 is a perspective view of a portion of a system for applying a spacer in accordance with various embodiments herein.

FIG. 6 shows a front view of the system during a step of applying a spacer 106 to a sheet 102 in accordance with various embodiments herein. The spacer 106 can be controlled after exiting the adhesive application element 552 by the front carriage 564 and/or the transport mechanism 556. FIGS. 7 and 8 show a close up of a portion of the spacer 106 being aligned with the sheet 102. FIGS. 7 and 8 show the front carriage 564 and a rear carriage 566.

The front carriage 564 can include a first roller 776 which is a vertical roller which can rotate around an axis along the Z-axis. The first roller 776 can move along the Y-axis and/or the longitudinal axis (X-axis) of the unadhered spacer, such as to clamp the spacer 106 along the transport mechanism 556. The first roller 776 can move along the X-axis, such as to follow the sheet 102. The second roller 778 or horizontal roller can move along the Z-axis, such as to press the spacer 106 against the sheet 102. The second roller 778 can move along the X-axis, such as to press along a portion of the spacer 106 to contact the sheet 102. In various embodiments, the axis of rotation for a vertical roller can be perpendicular to the axis of rotation for a horizontal roller.

The sheet 102 can be held by the robot 558 in a pre-stage position, such as while the robot 558 waits for the spacer 106 to exit the adhesive application element 552. The pre-stage position can be parallel or nearly parallel with the spacer 106 with the sheet 102 a distance away from the application position. The sheet 102 can rest on rollers (not shown), the first rear carriage 566, and/or the second rear carriage 682.

As the spacer 106 exits the adhesive application element 552, the robot 558 (holding the sheet 102) can match the speed of the spacer 106 in the +X direction, and position the sheet 102 to attached the first end 328 with the first corner 568. At this point, the robot 558, the sheet 102, and/or the spacer 106 can be moving in the +X direction at the same speed. In some embodiments, the sheet 102 and the spacer 106 can continue moving in the +X direction while the front carriage 564 and the rear carriage are in a fixed location, such as to feed the sheet 102 and the spacer 106 through the front carriage 564 and the rear carriage 566. In some embodiments, the sheet 102 and the spacer 106 can be still or in a fixed location as the front carriage 564 moves in the −X direction, such as to feed the sheet 102 and the spacer 106 through the front carriage 564 and rear carriage 566. In some embodiments, the sheet 102 and the spacer 106 can move in the +X direction and the front carriage 564 can simultaneously move in the −X direction, such as to feed the sheet 102 and the spacer 106 through the front carriage 564. In some embodiments, the front carriage 564 is configured to move in the opposite direction that the robot 558 translates the sheet 102 in while compressing the spacer 106 and the sheet 102.

Figure 12:
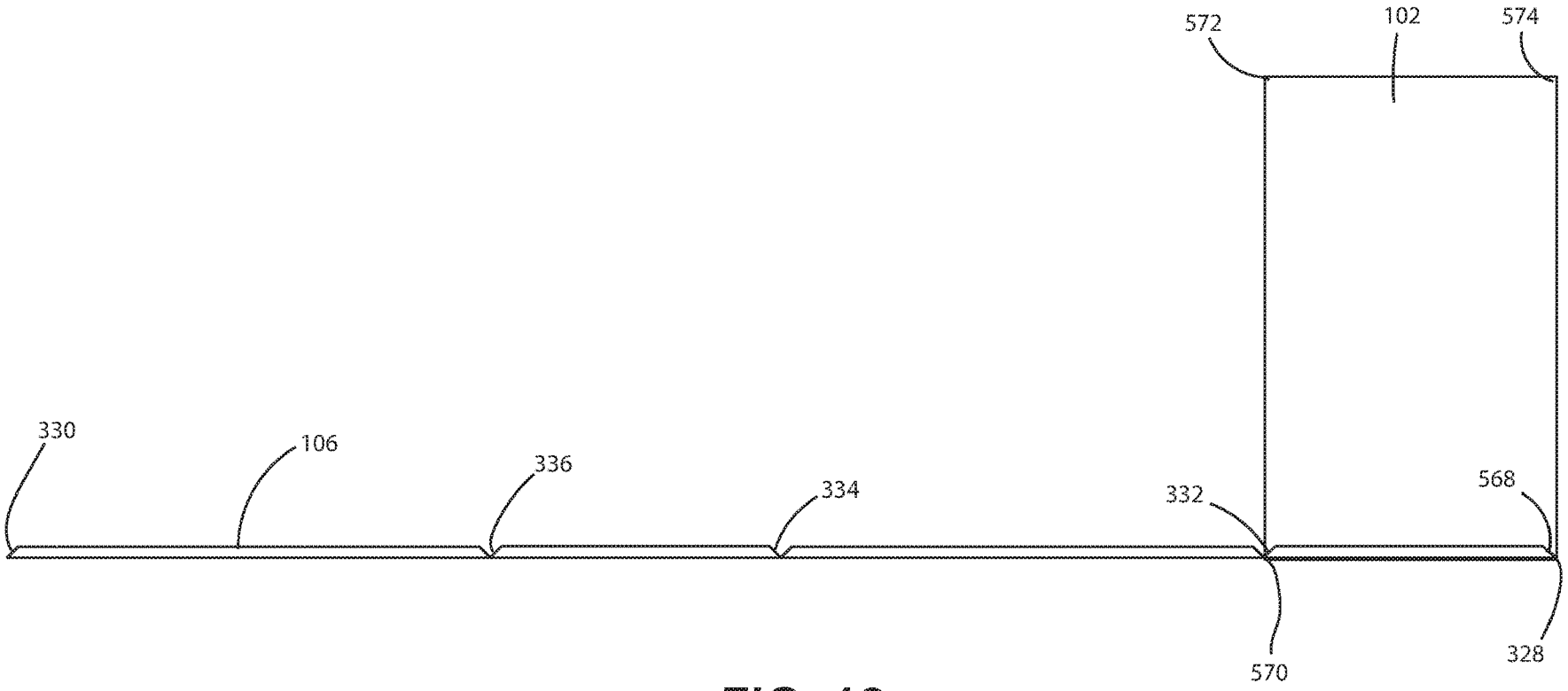
FIG. 12 is a schematic view of the spacer and the planar substrate in accordance with various embodiments herein.

In some embodiments, once the first leg of the spacer 106 (between the first end 328 and the first notch 332) is aligned with the edge of the sheet 102 between the first corner 568 and the second corner 570 (as shown in FIG. 12), the front carriage 564 can travel in the −X direction applying the spacer 106 to the sheet 102, such as with a pneumatically actuated roller 778, the sheet 102 and the spacer 106 can moved in the +X direction, or a combination thereof. In some embodiments, while the front carriage 564 is moving in the −X direction the sheet 102 and the spacer 106 can continue to move in the +X direction, such as at the same speed as the spacer 106 is exiting the adhesive application element 552. In some embodiments, the front carriage 564 can travel in the −X direction at about 1500 mm/s.

Figure 11:
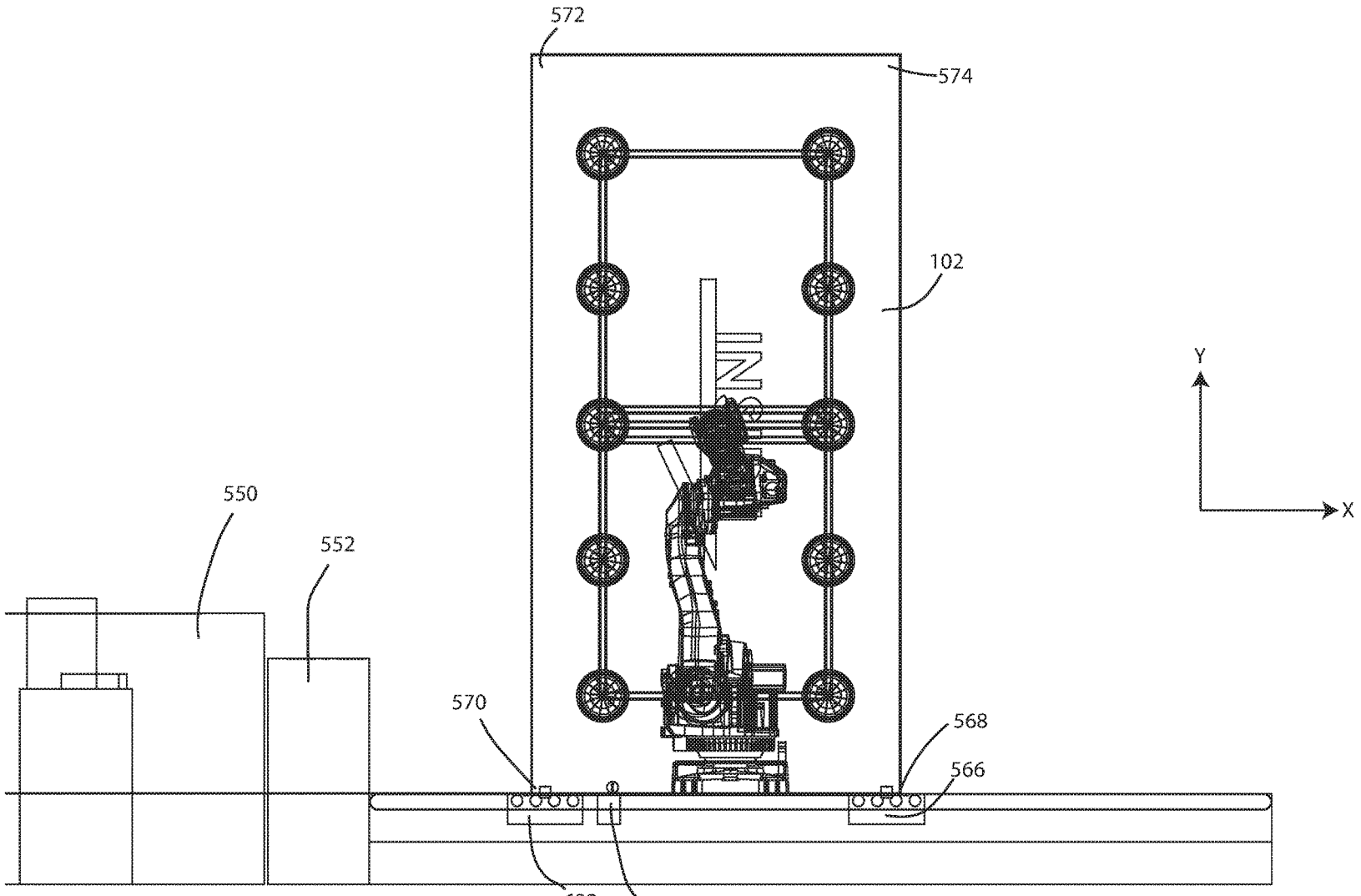
FIG. 11 is a front view of a system for applying a spacer in accordance with various embodiments herein.

In some embodiments, the front carriage 564 can travel towards the second corner 570 for a distance that is less than the distance between the first corner 568 and the second corner 570, or a portion of the sheet 102 and the spacer 106 that is less than the distance between the first end 328 and the first notch 332. In some embodiments, the front carriage 564 travels 50% of the distance towards the second corner 570 from the first corner 568 or 50% of the sheet 102 between the first corner 568 and the second corner 570 and 50% of the spacer 106 between the first end 328 and the first notch 332 is fed through the front carriage 564. In other examples, the percentage can be 60%, 70%, 80%, 90%, or 95%. In various embodiments the front carriage 564 does not travel the entire length of the spacer 106 between the first end 328 and the first notch 332, such as shown in FIG. 11. After the front carriage 564 has reached its desired amount of travel in the −X direction, the robot 558 can start locating a new tool center at the second corner 570.

FIG. 9 shows a schematic of a portion of the sheet 102 and spacer 106 being fed through the front carriage 564 and the rear carriage 566 in accordance with various embodiment herein. FIG. 9 shows the sheet 102 and the spacer 106 with adhesive 980 disposed between. In FIG. 9, the sheet 102 and spacer 106 are being fed from left to right between the front carriage 564 and the rear carriage 566. The portion of the spacer 106 that has already been fed through the carriages 564, 566 is adhered to the sheet 102 resulting in an adhered portion 982 of the spacer 106 and an unadhered portion 984 of the spacer 106. In various embodiments, a gap or space 986 can be defined between the adhesive 980 and the sheet 102 before the portions of the sheet 102 and spacer 106 have passed through the front carriage 564 and the rear carriage 566.

Figure 10:
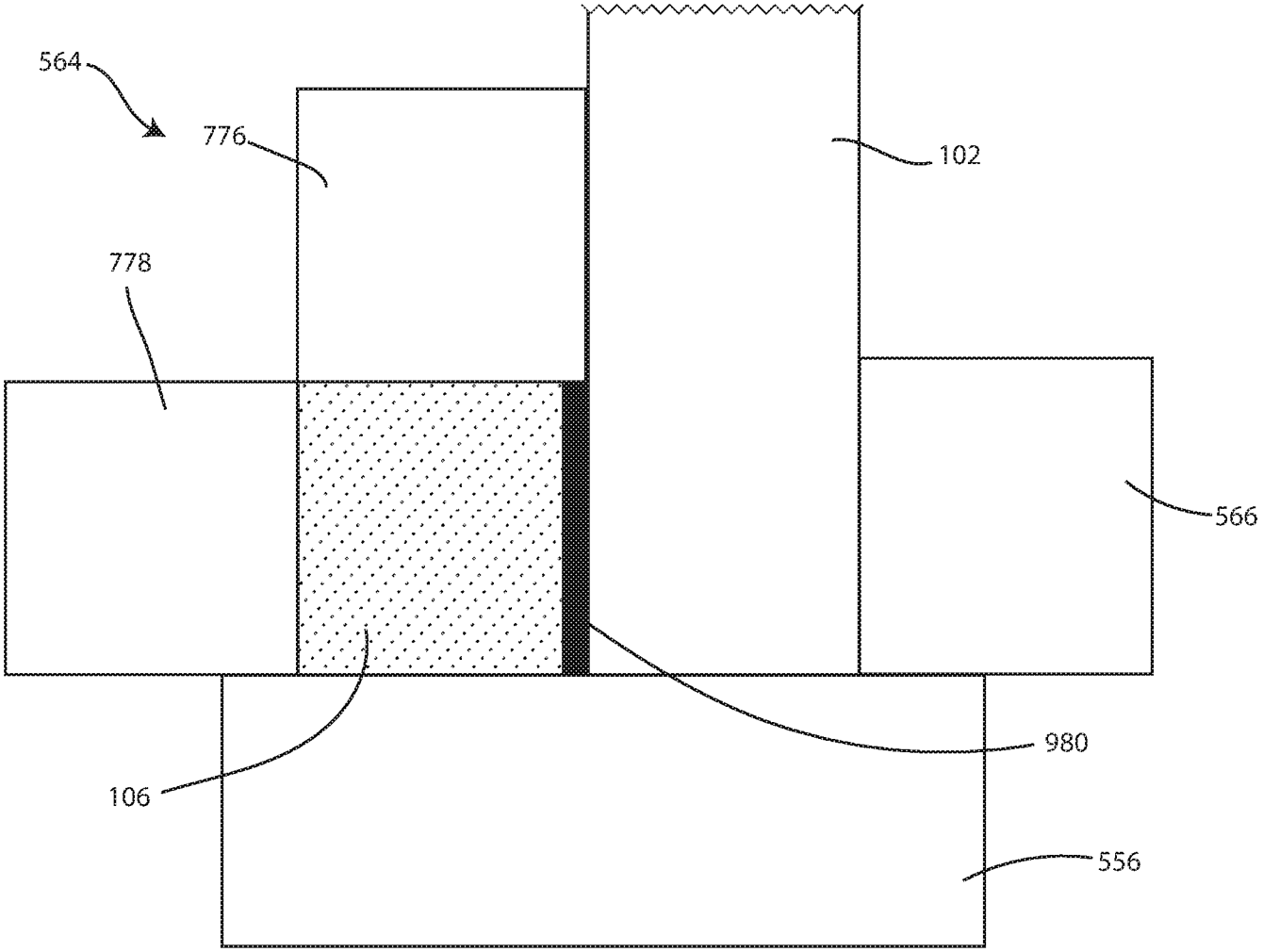
FIG. 10 is a schematic of a portion of the planar substrate and spacer being fed through the front carriage and rear carriage in accordance with various embodiment herein.

FIG. 10 shows a cross-section schematic of a portion of the sheet 102 and a portion of the spacer 106 being fed between the front carriage 564 and the rear carriage 566 in accordance with various embodiment herein. The front carriage 564 can include a horizontal roller 778 and a vertical roller 776. The vertical roller 776 and the transport mechanism 556 can restrict movement of the spacer 106 in the Y-direction. The horizontal roller 778 and sheet 102 can restrict movement of the spacer 106 in the Z-direction. Restricting movement of the spacer 106 can ensure the system continues to know the location of the spacer and ensure proper alignment of the spacer 106 and the sheet 102.

FIG. 11 shows the sheet 102 in position for a first leg or portion of the spacer 106 to be applied the sheet. For clarity purposes, the spacer is not shown in FIG. 11. FIG. 12 shows a schematic view of the spacer 106 and the planar substrate aligned in accordance with the configuration of FIG. 11.

As shown in FIG. 12, the first end 328 can be aligned with the first corner 568 of the sheet 102. At the same time, the first notch 332 can be aligned with the second corner 570 of the sheet 102. In some embodiments, as the first portion of the spacer 106 is aligned with the sheet 102, a portion of the spacer 106 (such as the second end 330) can still be within the spacer preparation element 550, such as still wound on a spool or not separated from a remainder of the spacer material. When the first end 328 of the spacer 106 is aligned with the first corner 568 of the sheet 102, the spacer 106 will already have the first notch 332 cut. However, in some embodiments, when the first end 328 of the spacer 106 is aligned with the first corner 568 of the sheet 102, the spacer 106 will not have one or more of the second notch or third notch cuts made. FIG. 12 represents the configuration of the spacer 106 and the sheet 102 once the first end 328 is aligned with the first corner 568, and before the spacer 106 and the sheet 102 have been fed through the front carriage 564 and the rear carriage 566. In various embodiments, the first end 328 can be disposed between the front carriage 564 and the rear carriage 566 in the configuration of FIG. 12.

Figure 13:
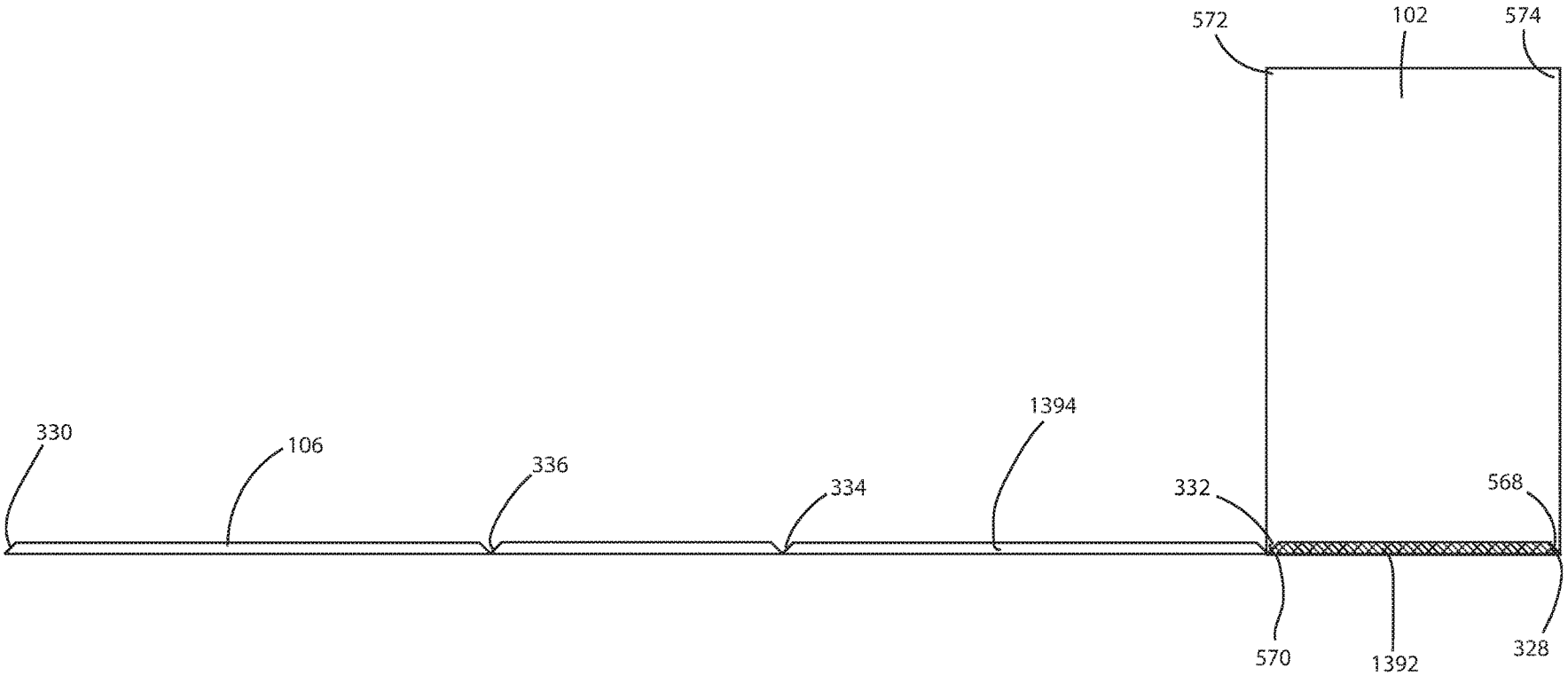
FIG. 13 is a schematic view of the spacer and the planar substrate in accordance with various embodiments herein.

FIG. 13 is a schematic view of the spacer 106 and the sheet 102 from FIG. 12 after the first portion has passed between the front carriage 564 and the rear carriage 566 resulting in a first adhered portion 1392 and an unadhered portion 1394 of the spacer 106.

After the first portion 1392 is adhered to the sheet 102, the system can rotate, or rotate and translate, the sheet 102 in preparation for a second portion of the spacer 106 to be adhered between the second corner 570 and the third corner 572. In some embodiments, as the sheet 102 is rotated, or rotated and translated, the spacer 106 is further fed in the +X direction to keep the spacer 106 aligned with sheet 102.

Figure 14:
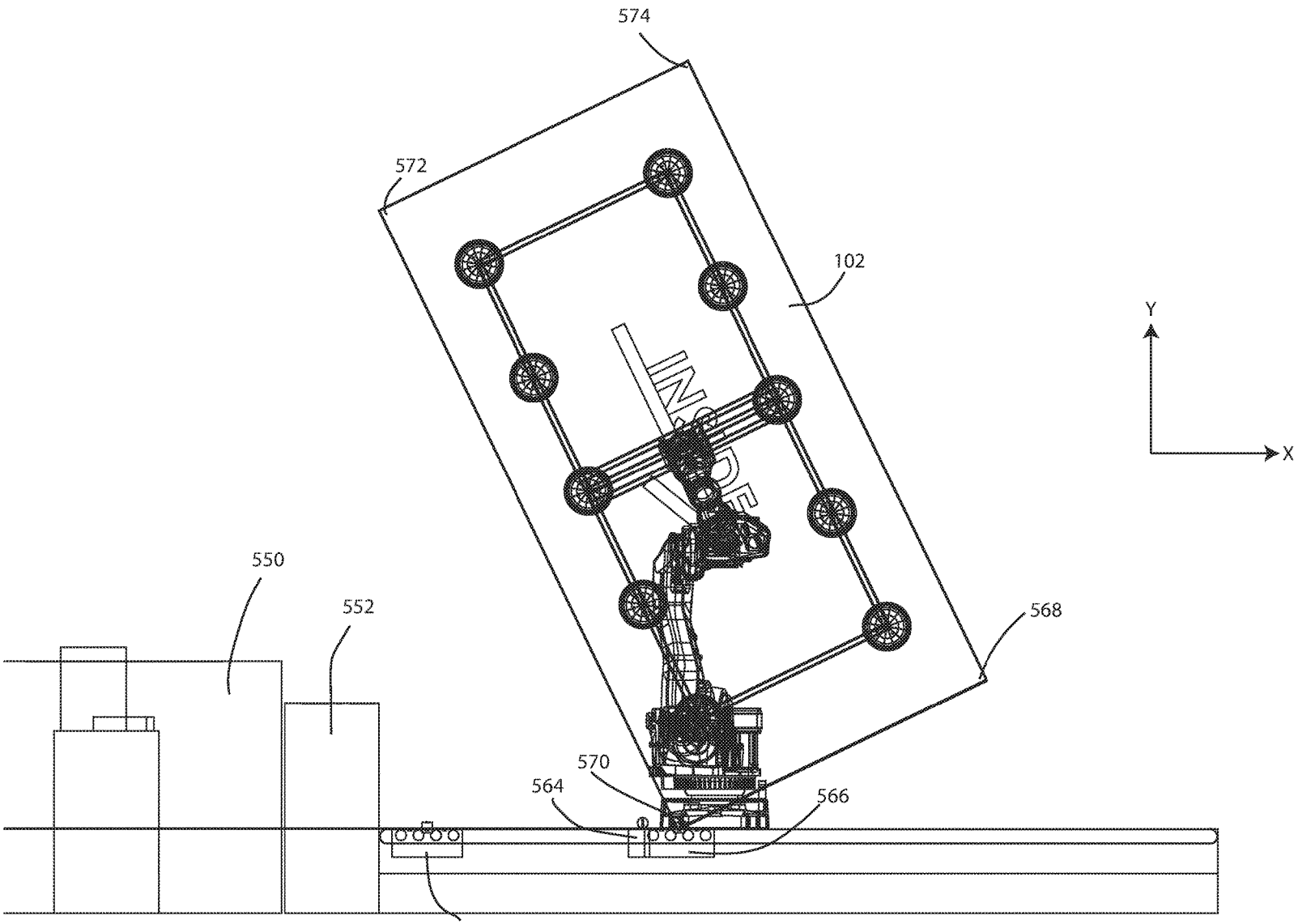
FIG. 14 is a front view of a system for applying a spacer in accordance with various embodiments herein.

In reference now to FIG. 14, a front view of the system 500 for applying a spacer is shown in accordance with various embodiments herein. In various embodiments, as soon as possible after the components are in a clear to rotate state, such as after a translation in the +X direction, the robot 558 can start to rotate the sheet 102 about the second corner 570. The second corner 570 can continue to move in the +X direction at the constant speed at which the spacer 106 is exiting the adhesive application element 552. The robot 558 can rotate the sheet 102 at a rate (relative to the movement in +X direction) that keeps the third corner 572 in a safe zone, such that the third corner 572 does not contact or hit any other components, such as the adhesive application element 552. In some embodiments, the rotation of the sheet 102 can be performed in an efficient manner such that the base 560 can remain stationary. In other embodiments, the base 560 can travel along the X-axis as needed. In some embodiments, the robot 558 can keep the sheet 102 a small distance away, such as in the −Z direction as shown as gap 986 in FIG. 9, from the second notch 334 of the spacer 106, such as to avoid smearing the adhesive that is disposed on the spacer 106.

Figure 15:
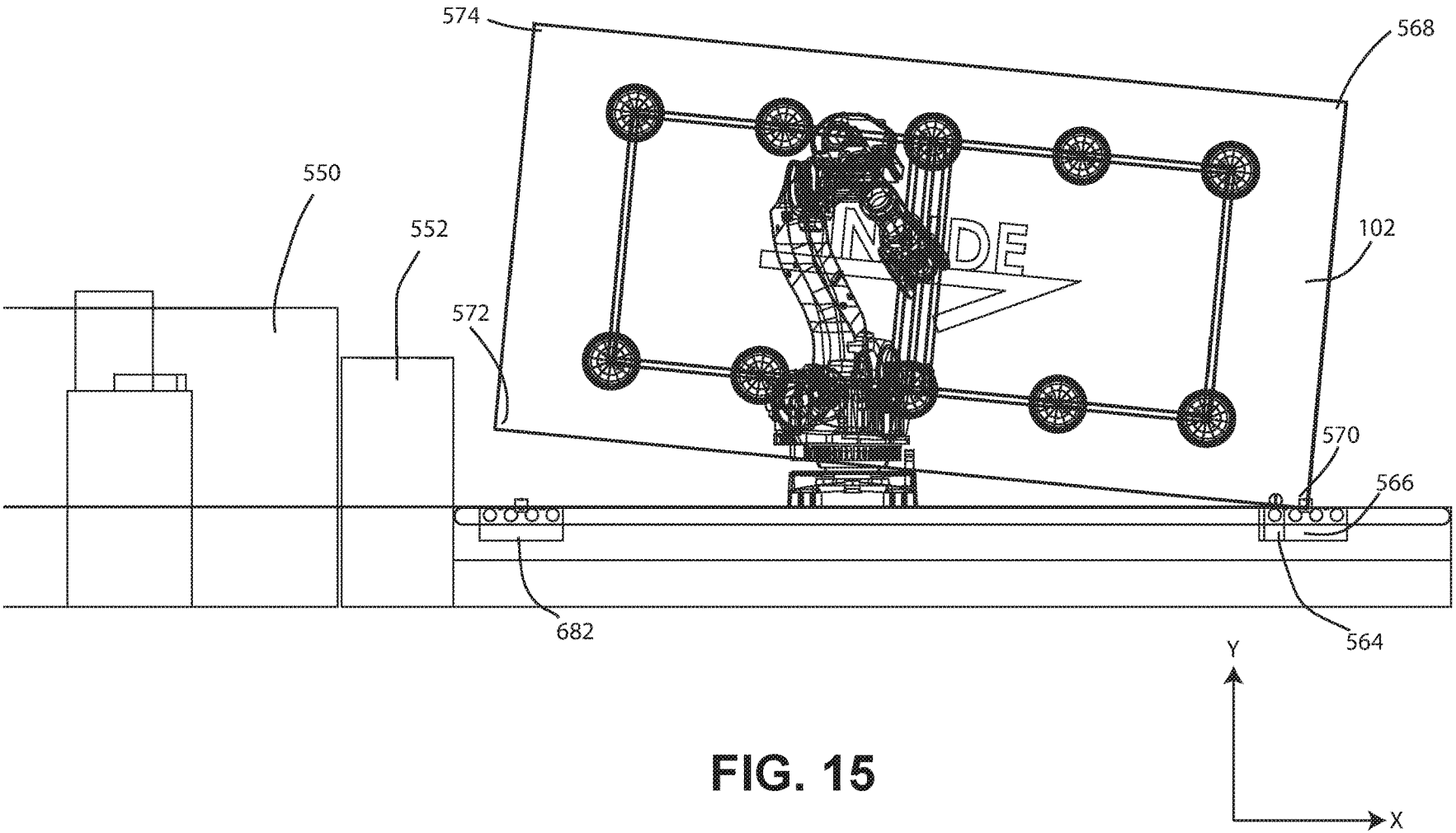
FIG. 15 is a front view of a system for applying a spacer in accordance with various embodiments herein.

In reference now to FIG. 15, a front view of the system 500 for applying a spacer is shown in accordance with various embodiments herein. When the robot 558 is nearing the completion of rotating the glass about the second corner 570, the robot 558 can continue to move the sheet 102 in the +X direction at the constant speed. The front carriage 564 can be positioned to attach the beginning of the next leg of the spacer 106, such as the portion of the spacer 106 between the second notch 334 and the third notch 336. The third corner 572 and the third notch 336 can be aligned as soon as possible without the third corner 572 rotating into any other components or into a safe boundary.

Figure 16:
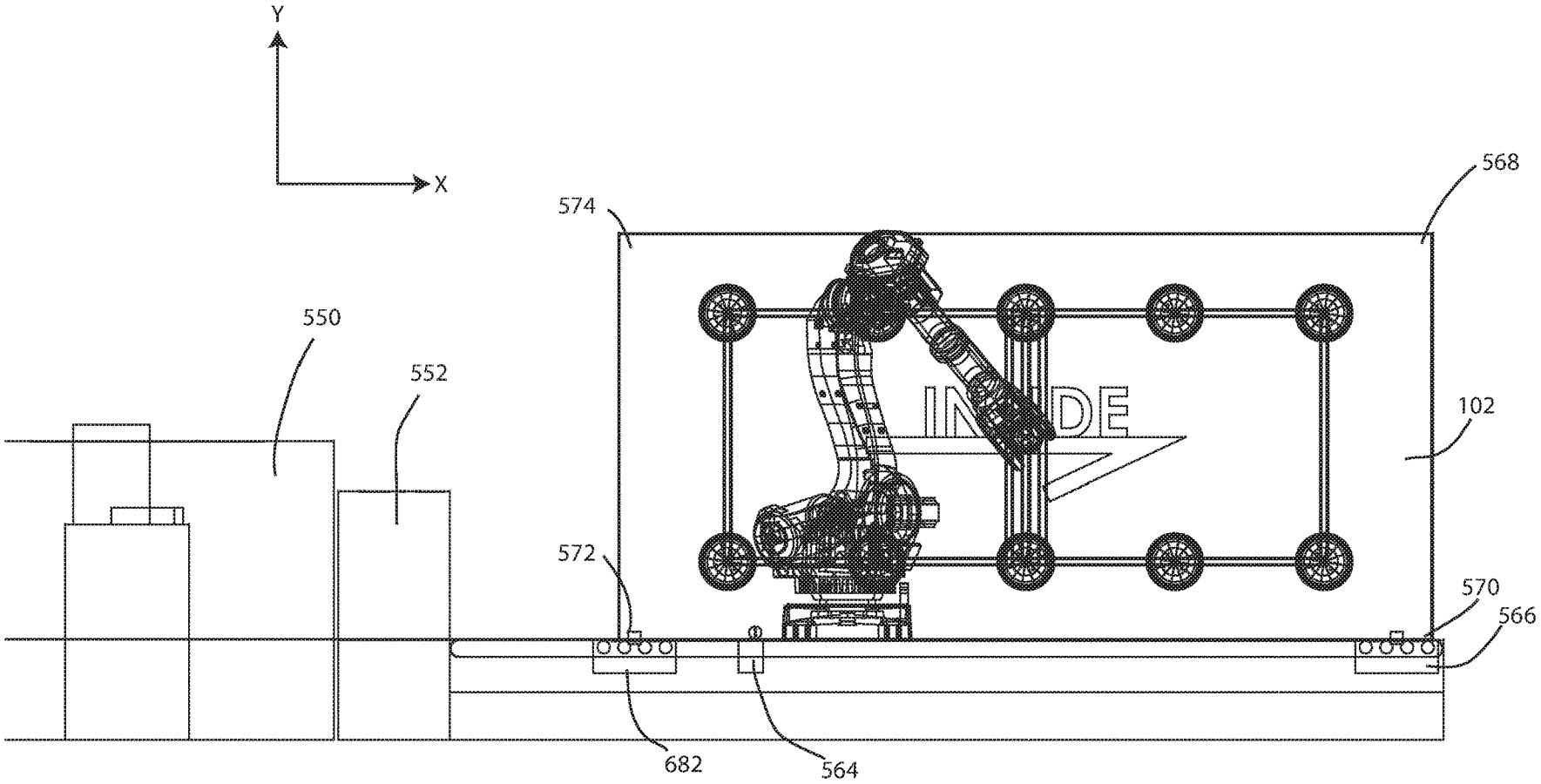
FIG. 16 is a front view of a system for applying a spacer in accordance with various embodiments herein.

In reference now to FIG. 16, a front view of the system 500 for applying a spacer is shown in accordance with various embodiments herein. In various embodiments, the robot 558 can have finished rotating the sheet 102 around the second corner 570. The robot 558, the second corner 570, the third corner 572, and/or the spacer 106 can be traveling in the +X direction at the same constant speed. The front carriage 564 can once again travel in the −X direction applying 75%-80% of the spacer 106 to the sheet 102, while the other components continue to travel in the +X direction. In some embodiments, the front carriage 546 travels in the −X direction for at least 50% of the length of the leg of the spacer 106 being applied to the sheet 102 and not more than 90% of the length of the leg. After the front carriage 546 completes its travel in the −X direction, the robot 558 can start locating a new tool center at the third corner 572. The steps shown in FIGS. 6, 11, and 14-16 can be repeated until all of the legs of the spacer are attached to the glass, such as shown in FIGS. 17-22. In various embodiments, once the second end 330 of the spacer exits the adhesive application element 552, the robot 558 no longer needs to match the same speed at which the spacer 106 was exiting the adhesive application element 552.

Figure 17:
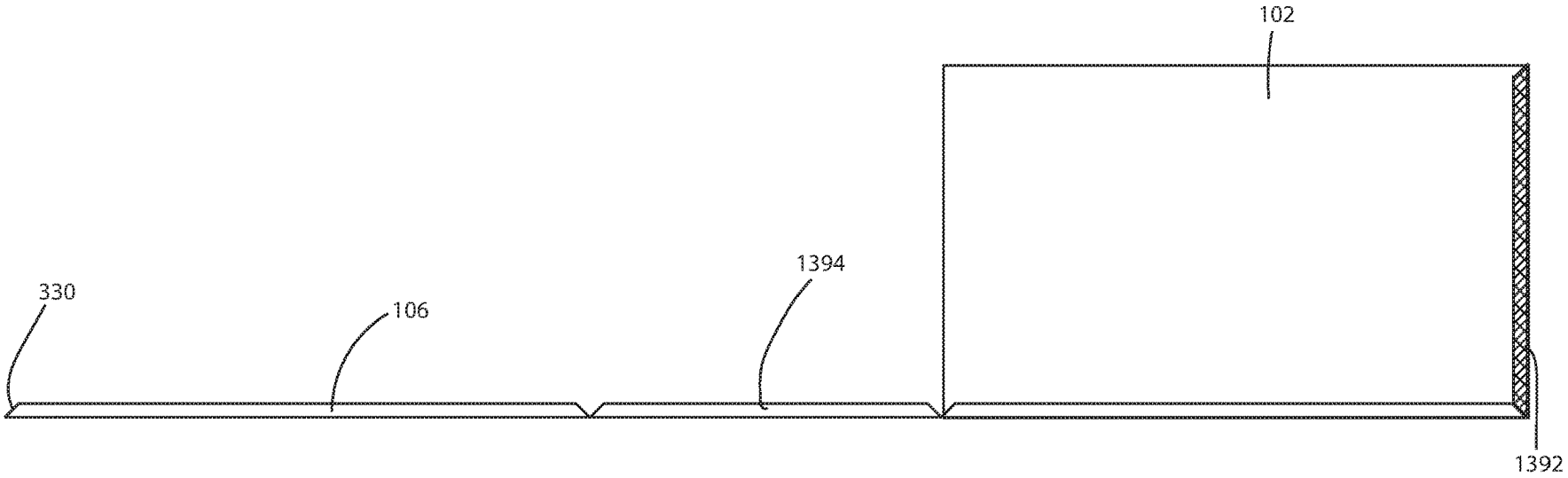
FIG. 17 is a schematic view of the spacer and the planar substrate in accordance with various embodiments herein.
Figure 18:
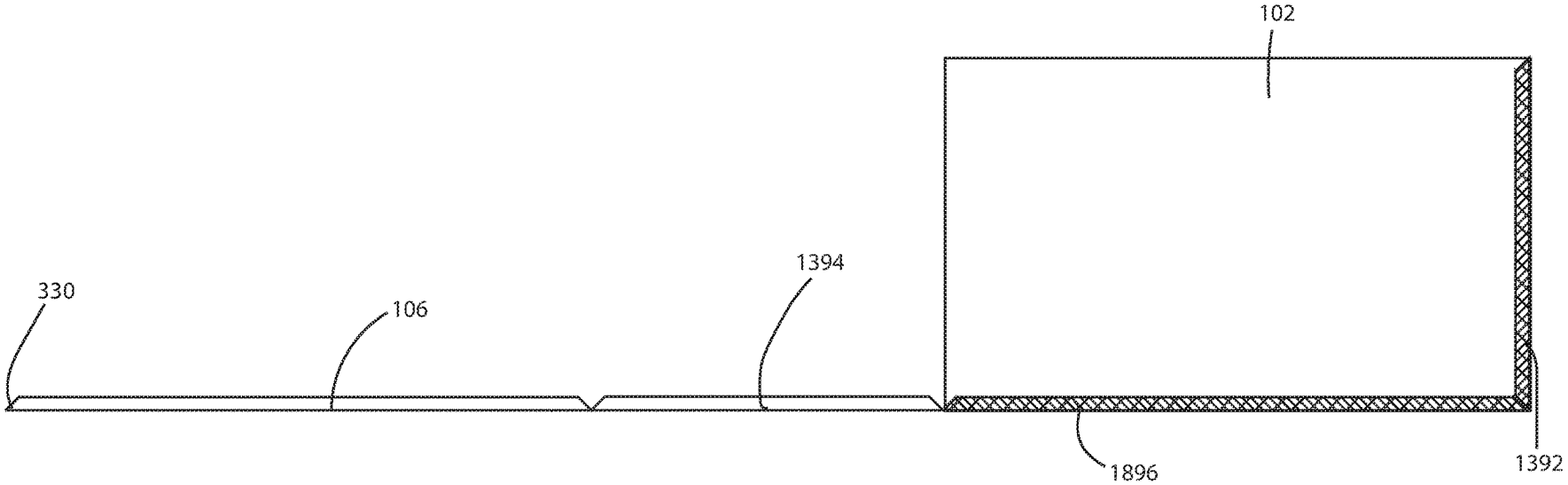
FIG. 18 is a schematic view of the spacer and the planar substrate in accordance with various embodiments herein.

FIG. 17 shows a schematic view of the spacer 106 and the sheet 102 with the second notch 334 aligned with the third corner 572 prior to feeding the portion of the spacer 106 between the first notch 332 and the second notch 334 and the portion of the sheet 102 between the front carriage 564 and the rear carriage 566. FIG. 18 shows a view of FIG. 17 after the second adhered portion 1896 has been formed.

Figure 19:
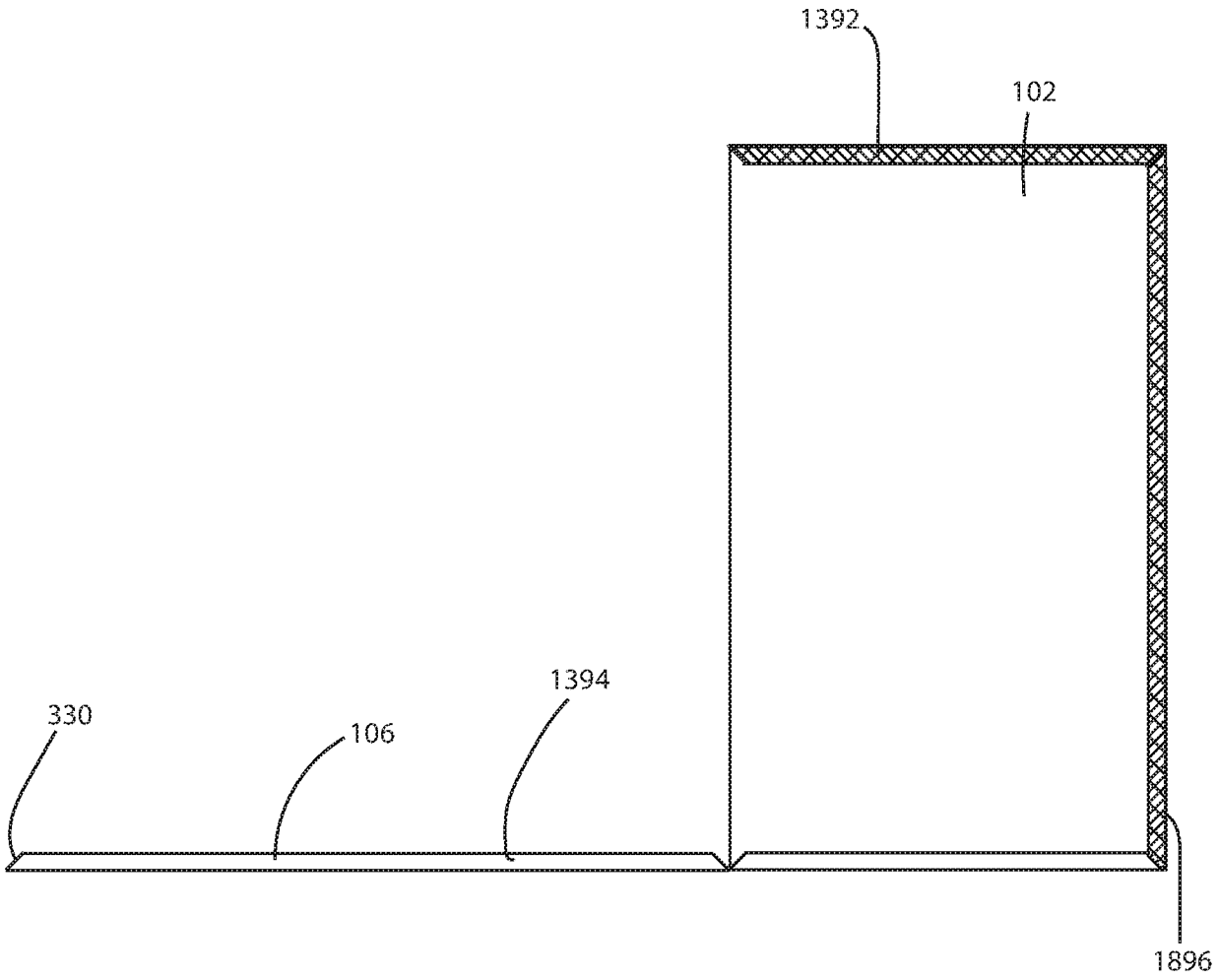
FIG. 19 is a schematic view of the spacer and the planar substrate in accordance with various embodiments herein.
Figure 20:
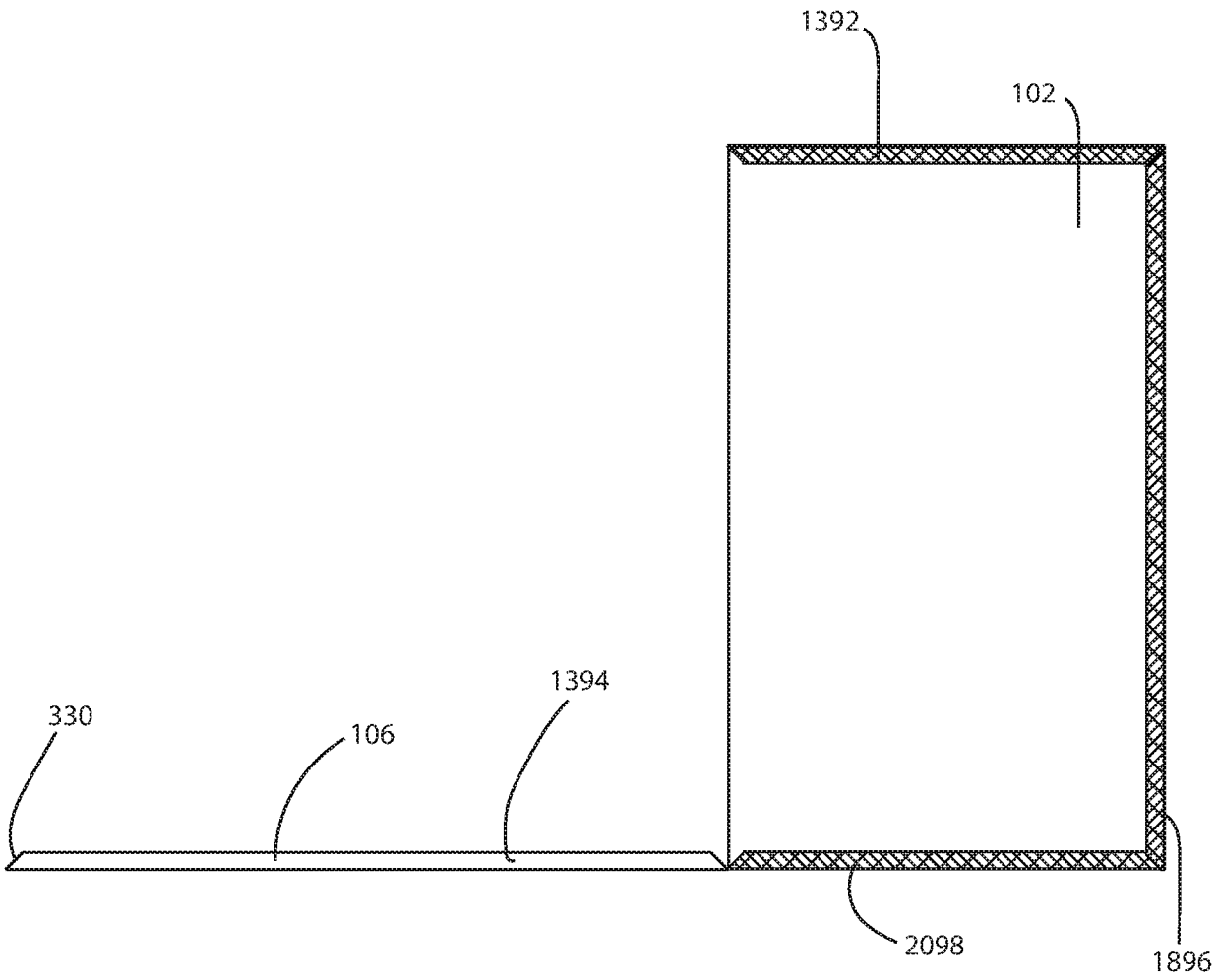
FIG. 20 is a schematic view of the spacer and the planar substrate in accordance with various embodiments herein.

FIG. 19 shows a schematic view of the spacer 106 and the sheet 102 with the third notch 336 aligned with the fourth corner 574 prior to feeding the portion of the spacer 106 between the second notch 334 and the third notch 336 and the portion of the sheet 102 between the front carriage 564 and the rear carriage 566. FIG. 20 shows a view of FIG. 19 after the third adhered portion 2098 has been formed.

Figure 21:
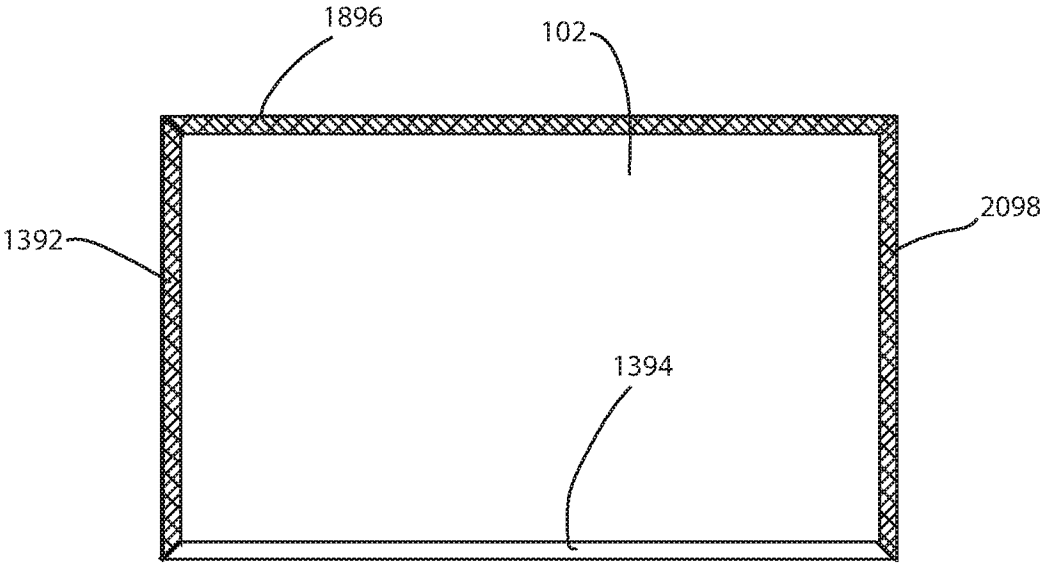
FIG. 21 is a schematic view of the spacer and the planar substrate in accordance with various embodiments herein.
Figure 22:
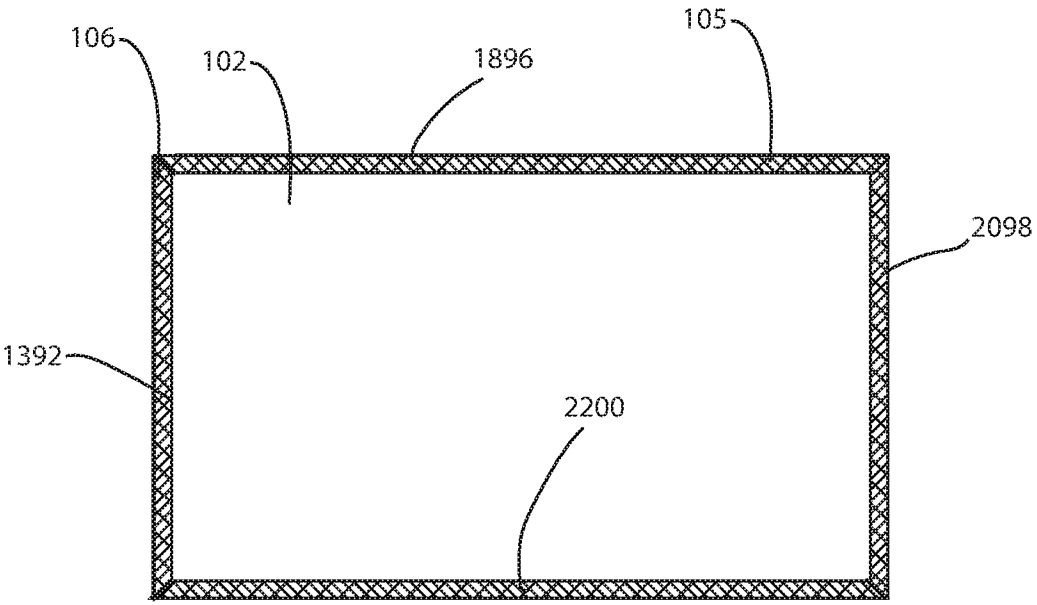
FIG. 22 is a schematic view of the spacer and the planar substrate in accordance with various embodiments herein.
Figure 23:
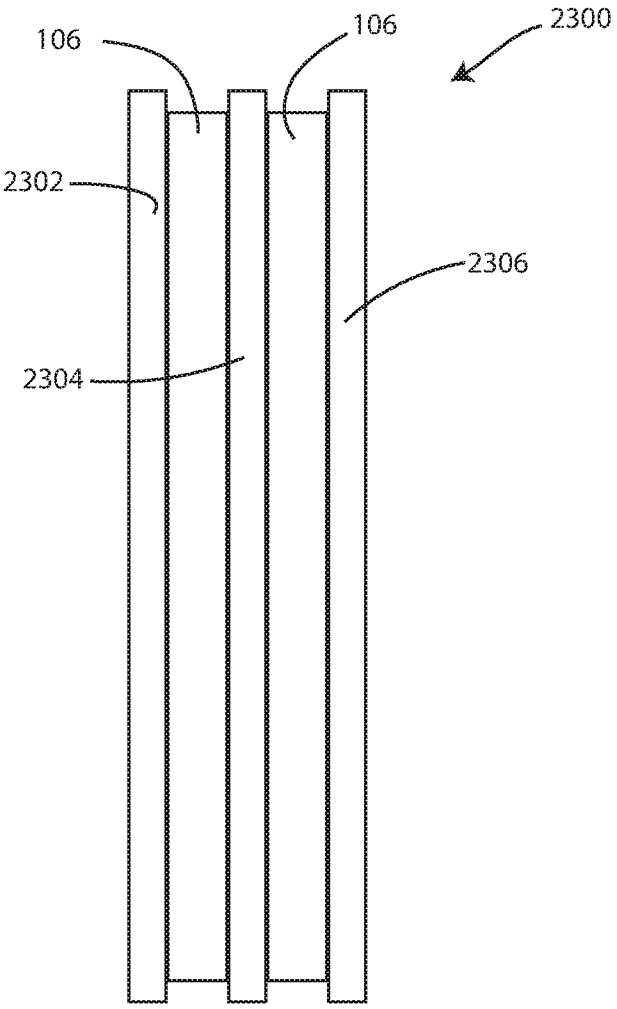
FIG. 23 is a schematic side view of an insulated glass unit (IGU) in accordance with various embodiments herein.

FIG. 21 shows a schematic view of the spacer 106 and the sheet 102 with the second end 330 aligned with the first corner 568 prior to feeding the portion of the spacer 106 between the third notch 336 and the second end 330 and the portion of the sheet 102 between the front carriage 564 and the rear carriage 566. FIG. 22 shows a view of FIG. 21 after the fourth adhered portion 2200 has been formed to close the spacer frame 105.

The final corner of the spacer can be closed in various different manners. In some embodiments, the robot 558 can complete another 90° rotation of the frame around the first corner 568 until the starting leg between the first corner 568 and the second corner 570 is parallel with the conveyor or transport mechanism to bend the tail 338, such as by using the conveyor 780 to press the corner closed. In various embodiments, a surface or roller on the second rear carriage, in combination with robot 558 moves to close the fourth corner of the spacer frame. In some embodiments, a clamp can be used to close and hold the fourth corner closed. In some embodiments, the fourth corner can use a miter joint on a flat leg of the spacer 106. Other joints can also be used to close the final corner of the spacer frame 105

In various embodiments, after the spacer 106 has been completely adhered to the sheet 102, a second sheet 104 can be adhered to the opposite side of the spacer 106, such as to form the window assembly 100 shown in FIG. 1. In some embodiments, adhesive for attaching the second sheet 104 can be applied to the spacer 106 after the spacer 106 is adhered to the first sheet 102. In some embodiments, adhesive for attaching the second sheet 104 can be applied to the spacer 106 simultaneously with adhesive for attaching the spacer 106 to the first sheet 102.

Triple Pane

FIGS. 23-28 show various embodiments related to triple pane windows. A triple pane window 2300 can include a first sheet 2302, a second sheet 2304 and a third sheet 2306. It should be understood that the sheets 2302, 2304, 2306 can be equivalent to the sheets 102, 104 discussed above.

The second sheet 2304 can be disposed between the first sheet 2302 and the third sheet 2306. The first sheet 2302 can be separated from the second sheet 2304 with a spacer 106. Similarly, the second sheet 2304 can be separated from the third sheet 2306 with a second spacer 106. Generally, the spacers 106 can be adhered to a sheet 2302, 2304, 2306 as discussed above.

Figure 24:
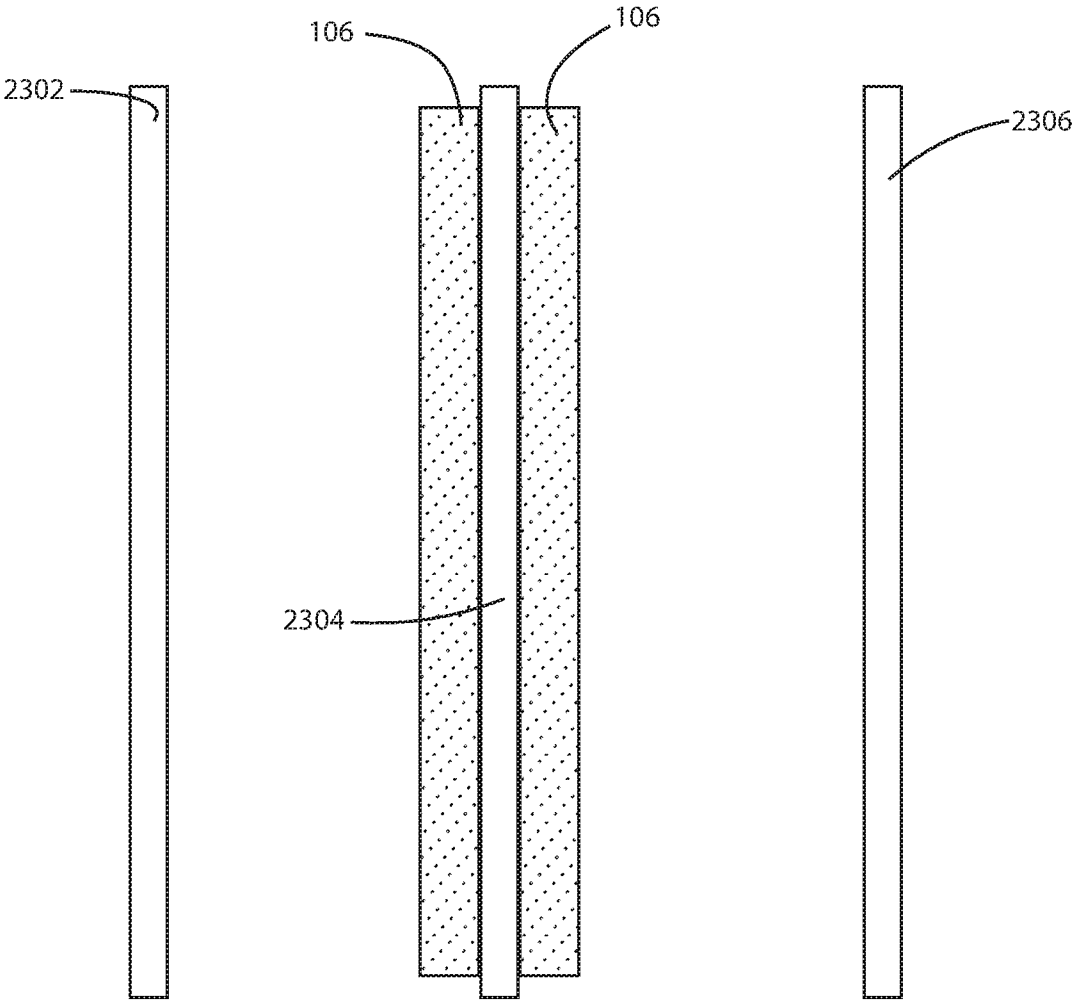
FIG. 24 is a schematic side view of a manufacturing step of an IGU in accordance with various embodiments herein.

FIG. 24 shows a schematic side view of a manufacturing step of a triple pane IGU in accordance with various embodiments herein. In some embodiments, the spacers 106 are both adhered to the middle or second sheet 2304. In some embodiments, both spacers 106 can be applied to the second sheet 2304 simultaneously. In various embodiments, the first sheet 2302 and the third sheet 2306 can be adhered to the respective spacers 106 after the spacers have been adhered to the second sheet 2304.

Figure 26:
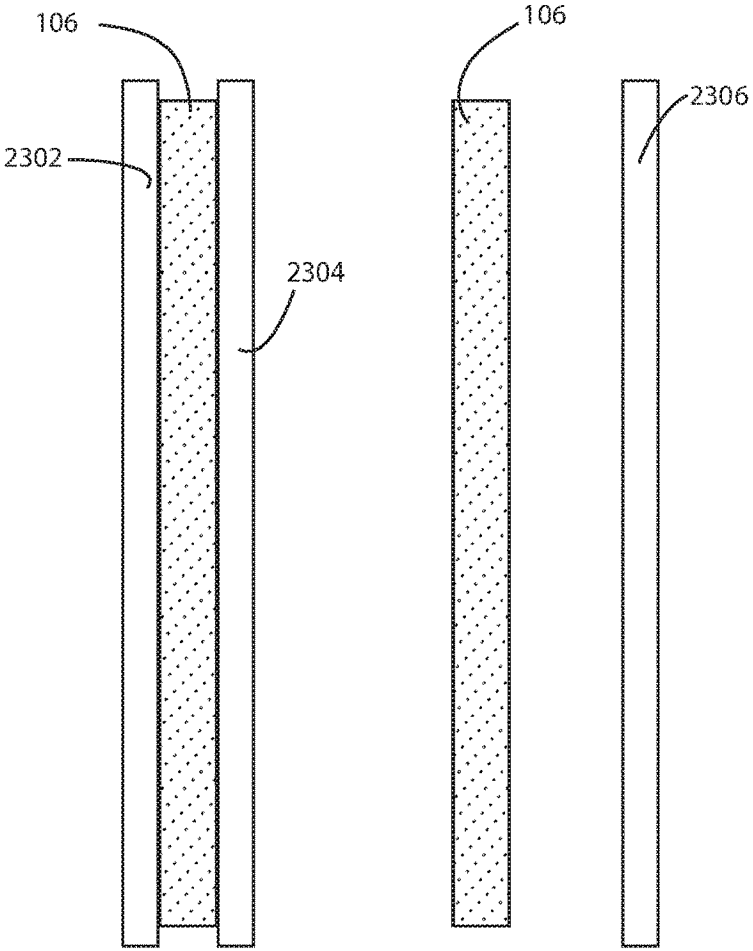
FIG. 26 is a schematic side view of a manufacturing step of an IGU in accordance with various embodiments herein.
Figure 25:
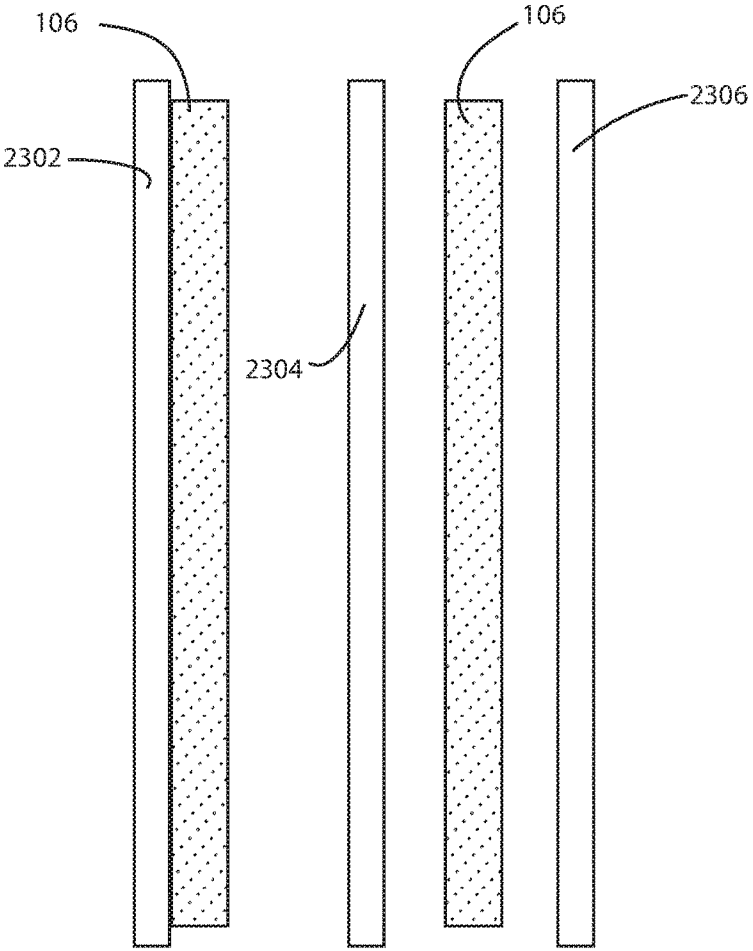
FIG. 25 is a schematic side view of a manufacturing step of an IGU in accordance with various embodiments herein.
Figure 27:
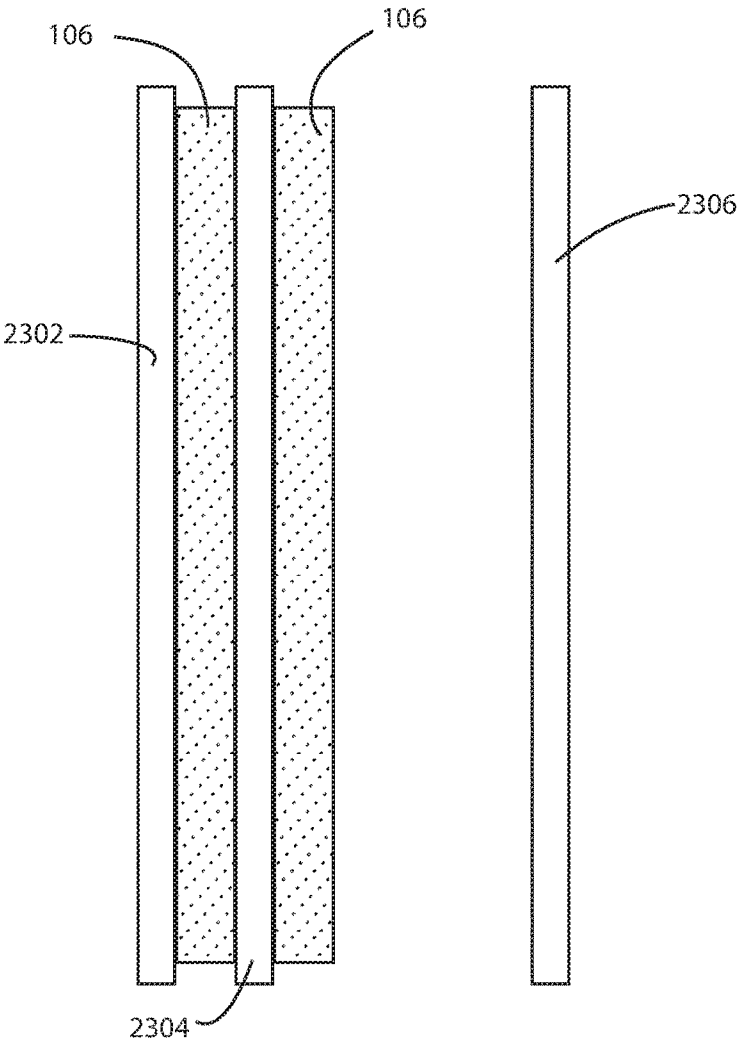
FIG. 27 is a schematic side view of a manufacturing step of an IGU in accordance with various embodiments herein.

FIGS. 25-27 show schematic side views of manufacturing steps of a triple pane IGU in accordance with various embodiments herein. In some embodiments, a spacer 106 is adhered to a first sheet 2302 in the manner discussed above, shown in FIG. 25. A second sheet 2304 can be adhered to the opposite side of the spacer 106 as the first sheet 2302, shown in FIG. 26. A second spacer 106 can be adhered to the opposite side of the second sheet 2304 in the manner discussed above, shown in FIG. 27. The third sheet 2306 can be adhered to the opposite side of the spacer 106 from the second sheet 2304.

Figure 28:
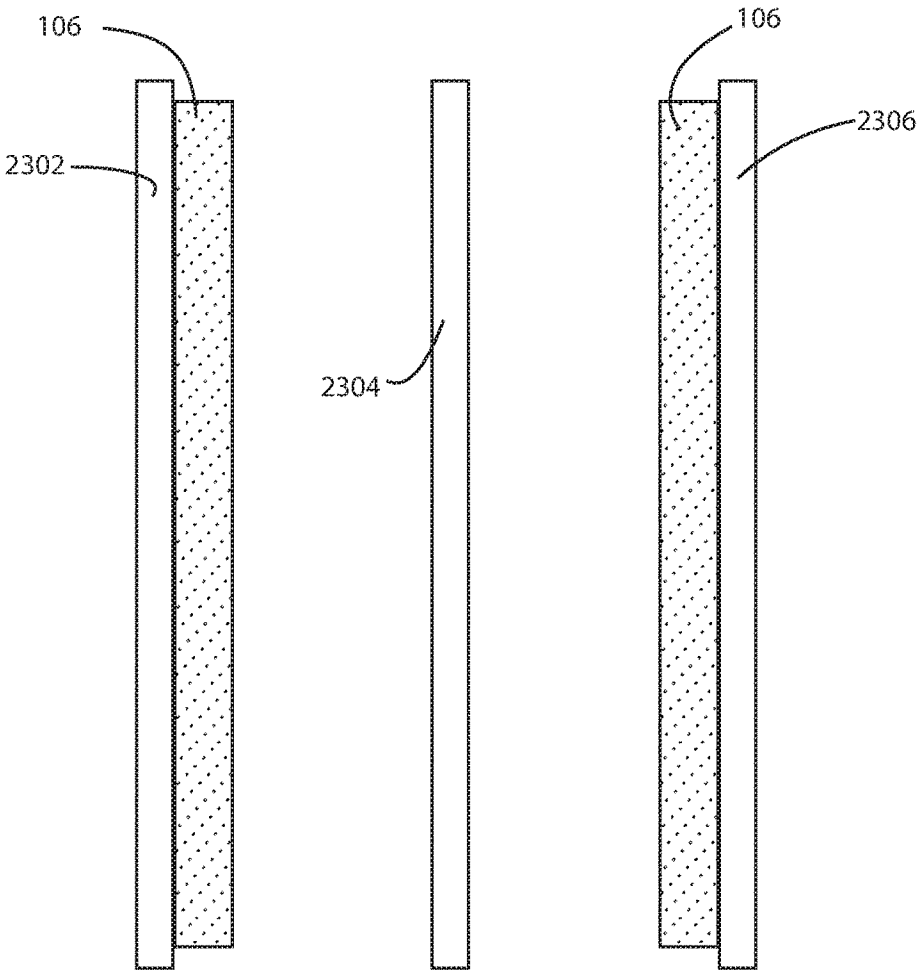
FIG. 28 is a schematic side view of a manufacturing step of an IGU in accordance with various embodiments herein.

FIG. 28 shows a schematic side view of a manufacturing step of a triple pane IGU in accordance with various embodiments herein. In some embodiments, a spacer 106 can be adhered to a first sheet 2302, and a second spacer 106 can be adhered to the third sheet 2306. The second sheet 2304 can be adhered to both spacers 106 to dispose the second sheet between the spacers 106 and the sheets 2302, 2306.

Methods

Many different methods are contemplated herein, including, but not limited to, methods of making, methods of using, and the like. Aspects of system/device operation described elsewhere herein can be performed as operations of one or more methods in accordance with various embodiments herein.

Figure 29:
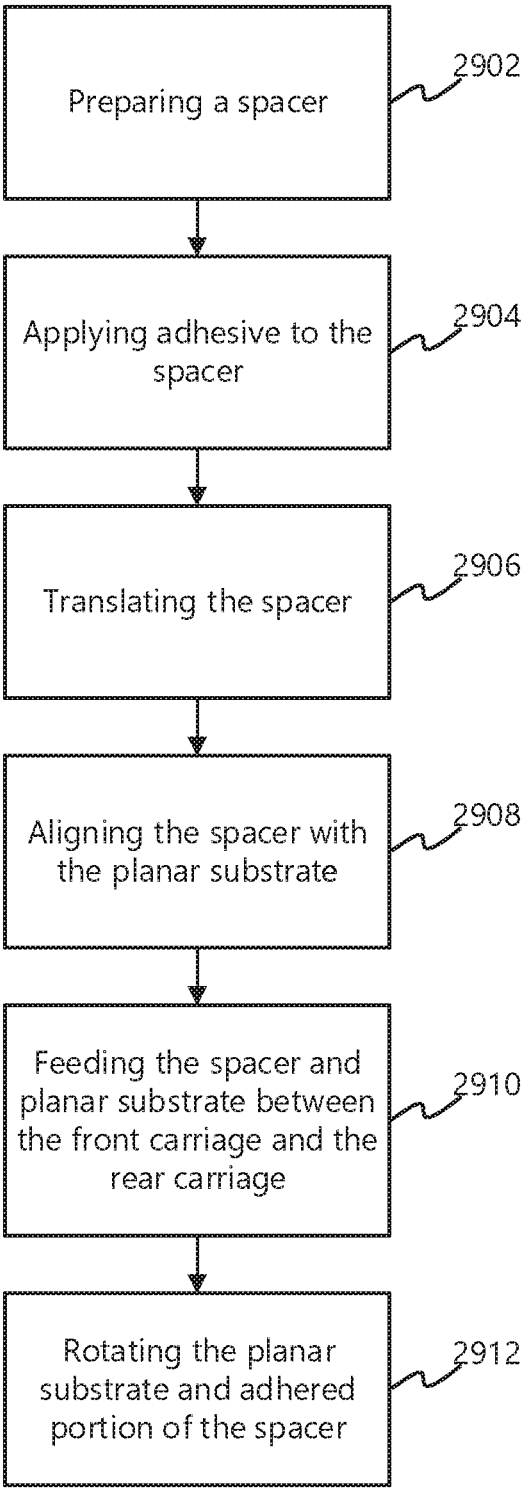
FIG. 29 is a flowchart showing a method of applying a spacer to a planar substrate in accordance with various embodiment herein.

FIG. 29 shows a flowchart of a method of applying a spacer to a planar substrate in accordance with various embodiments herein. In some embodiments, the method for applying a spacer to a planar substrate, includes preparing a spacer to be adhered to the planar substrate 2902. In some embodiments, the method includes applying an adhesive to a first side of the spacer 2904. In some embodiments, the method includes translating the spacer in a longitudinal direction 2906. In some embodiments, the method includes aligning a first end of the spacer with a first corner of the planar substrate 2908. In some embodiments, the method includes feeding the spacer and the planar substrate between a front carriage and a rear carriage 2910, such as along a longitudinal axis of an unadhered portion of the spacer while pressing the spacer against the planar substrate to adhere a portion of the spacer being pressed by the front carriage to the planar substrate, a portion of the spacer between a first end and a first notch and a portion of the planar substrate between the first corner and a second corner is fed between the front carriage and the rear carriage resulting in a first adhered length of the spacer. In some embodiments, the method includes rotating, with a six-axis robot, the planar substrate and the first adhered portion of the spacer to bend the spacer at the first notch 2912. The first notch can be aligned with the second corner of the planar substrate.

It should be understood that the feeding step 2910 and the rotating step 2912 can be repeated for each side or edge of the planar sheet. For example, a method for a rectangular planar substrate would further include feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the first notch and a second notch and a portion of the planar substrate between the second corner and a third corner is fed between the front carriage and the rear carriage resulting in a second adhered length of the spacer. The method would further include rotating, with a six-axis robot, the planar substrate, the first adhered portion of the spacer, and the second adhered portion of the spacer to bend the spacer at the second notch, wherein the second notch is aligned with the third corner of the planar substrate. The method would further include feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the second notch and a third notch and a portion of the planar substrate between the third corner and a fourth corner is fed between the front carriage and the rear carriage resulting in a third adhered length of the spacer. The method would further include rotating, with a six-axis robot, the planar substrate, the first adhered portion of the spacer, the second adhered portion of the spacer, and the third adhered portion of the spacer to bend the spacer at the third notch, wherein the third notch is aligned with the fourth corner of the planar substrate. The method would also include feeding the spacer and the planar substrate between the front carriage and the rear carriage along the longitudinal axis of the unadhered portion of the spacer while pressing the spacer against the planar substrate to adhere a portion of the spacer being pressed by the front carriage to the planar substrate, wherein a portion of the spacer between the third notch and a second end of the spacer and a portion of the planar substrate between the fourth corner and the first corner is fed between the front carriage and the rear carriage resulting in a fourth adhered length of the spacer.

In some embodiments, preparing the spacer to be adhered to the planar substrate, comprises: unwinding a length of spacer material from a spool of spacer material, straightening the length of spacer material that has been unwound from the spool, defining the first notch, the second notch, and the third notch in the length of spacer material, and separating the length of spacer material from the remainder of the spacer material on the spool to form the spacer that has the first end and the second end, and that is equivalent in length to a final spacer perimeter.

In some embodiments, the method further includes applying an adhesive to a first side of the spacer further comprises applying the adhesive to a second side of the spacer.

In some embodiments, the method further includes aligning the first end of the spacer with the first corner of the planar substrate results in the first end of the spacer being adjacent to or inset from the first corner of the planar substrate.

In some embodiments, the method further includes rotating the planar substrate and an adhered portion of the spacer comprises a rotation of 90°.

In some embodiments, the method further includes applying the adhesive to the first side of the spacer at least partially overlaps in time with feeding the spacer and the planar substrate between the front carriage and the rear carriage.

In some embodiments, the method further includes feeding the spacer and the planar substrate between the front carriage and the rear carriage, comprises moving the front carriage along the longitudinal axis of the unadhered spacer.

In some embodiments, the method further includes feeding the spacer and the planar substrate between the front carriage and the rear carriage, comprises moving the planar substrate and spacer along the longitudinal axis of the unadhered spacer.

In some embodiments, the method further includes at least one of the rotations of the planar substrate includes a translation and a rotation of the planar substrate.

In some embodiments, the method further includes the translation of the planar substrate involves feeding the planar substrate between the front carriage and the rear carriage.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

As used herein, the recitation of numerical ranges by endpoints shall include all numbers subsumed within that range (e.g., 2 to 8 includes 2.1, 2.8, 5.3, 7, etc.).

The headings used herein are provided for consistency with suggestions under 37 CFR 1.77 or otherwise to provide organizational cues. These headings shall not be viewed to limit or characterize the invention(s) set out in any claims that may issue from this disclosure. As an example, although the headings refer to a "Field," such claims should not be limited by the language chosen under this heading to describe the so-called technical field. Further, a description of a technology in the "Background" is not an admission that technology is prior art to any invention(s) in this disclosure. Neither is the "Summary" to be considered as a characterization of the invention(s) set forth in issued claims.

The embodiments described herein are not intended to be exhaustive or to limit the invention to the precise forms disclosed in the following detailed description. Rather, the embodiments are chosen and described so that others skilled in the art can appreciate and understand the principles and practices. As such, aspects have been described with reference to various specific and preferred embodiments and techniques. However, it should be understood that many variations and modifications may be made while remaining within the spirit and scope herein.

The invention claimed is:

1. A method for applying a spacer to a planar substrate, comprising:

a. supplying the spacer to be adhered to the planar substrate, wherein the spacer comprises a first spacer corner, a second spacer corner, and a third spacer corner, wherein the planar substrate comprises a first corner, a second corner, a third corner and a fourth corner;

b. applying an adhesive to the spacer;

c. translating the spacer in a longitudinal direction;

d. aligning a first end of the spacer with the first corner of the planar substrate;

e. feeding a first portion of the spacer and a first portion of the planar substrate between a front carriage and a rear carriage along a longitudinal axis of an unadhered portion of the spacer while pressing the first portion of the spacer against the first portion of the planar substrate to adhere the first portion of the spacer to the first portion of the planar substrate to result in a first adhered portion of the spacer, wherein the first portion of the spacer comprises the portion of the spacer between the first end of the spacer and the first spacer corner and the first portion of the planar substrate comprises the portion of the planar substrate between the first corner and the second corner is;

f. rotating, with a six-axis robot, the planar substrate and the first adhered portion of the spacer to bend the spacer at the first spacer corner, wherein the first spacer corner is aligned with the second corner of the planar substrate;

g. feeding a second portion of the spacer and a second portion of the planar substrate between the front carriage and the rear carriage along the longitudinal axis of the unadhered portion of the spacer while pressing the second portion of the spacer against the second portion of the planar substrate to adhere the second portion of the spacer to the second portion of the planar substrate to result in a second adhered portion of the spacer, wherein the second portion of the spacer comprises the portion of the spacer between the first spacer corner and the second spacer corner and the second portion of the planar substrate comprises the portion of the planar substrate between the second corner and the third corner;

h. rotating, with the six-axis robot, the planar substrate, the first adhered portion of the spacer, and the second adhered portion of the spacer to bend the spacer at the second spacer corner, wherein the second spacer corner is aligned with the third corner of the planar substrate;

i. feeding a third portion of the spacer and a third portion of the planar substrate between the front carriage and the rear carriage along the longitudinal axis of the unadhered portion of the spacer while pressing the third portion of the spacer against the third portion of the planar substrate to adhere the third portion of the spacer to the third portion of the planar substrate to result in a third adhered portion of the spacer, wherein the third portion of the spacer comprises the portion of the spacer between the second spacer corner and the third spacer corner and the third portion of the planar substrate comprises the portion of the planar substrate between the third corner and a fourth corner;

j. rotating, with the six-axis robot, the planar substrate, the first adhered portion of the spacer, the second adhered portion of the spacer, and the third adhered portion of the spacer to bend the spacer at the third spacer corner, wherein the third spacer corner is aligned with the fourth corner of the planar substrate; and k. feeding a fourth portion of the spacer and a fourth portion of the planar substrate between the front carriage and the rear carriage along the longitudinal axis of the unadhered portion of the spacer while pressing the fourth portion of the spacer against the fourth portion of the planar substrate to adhere the fourth portion of the spacer to the fourth portion of the planar substrate to result in a fourth adhered portion of the spacer, wherein the fourth portion of the spacer comprises the portion of the spacer between the third spacer corner and a second end of the spacer and the fourth portion of the planar substrate comprises the portion of the planar substrate between the fourth corner and the first corner.

2. The method of claim 1, wherein the supplying of the spacer to be adhered to the planar substrate, comprises:

a. unwinding a length of spacer material from a spool of spacer material; b. straightening the length of spacer material that has been unwound from the spool; c. defining a first notch at the first spacer corner, a second notch at the second spacer corner, and a third notch at the third spacer corner;
and d. separating the length of spacer material from the remainder of the spacer material on the spool to form the spacer that has the first end and the second end, and that is equivalent in length to a final spacer perimeter.

3. The method of claim 1, wherein the applying of the adhesive to the spacer further comprises applying the adhesive to a first side of the spacer and to a second side of the spacer.

4. The method of claim 1, wherein the aligning of the first end of the spacer with the first corner of the planar substrate results in the first end of the spacer being adjacent to or inset from the first corner of the planar substrate.

5. The method of claim 1, wherein the rotating of the planar substrate and one of the first adhered portion, the second adhered portion, the third adhered portion, of the spacer comprises a rotation of 90°.

6. The method of claim 1, wherein the applying of the adhesive to the spacer at least partially overlaps in time with feeding the spacer and the planar substrate between the front carriage and the rear carriage.

7. The method of claim 1, wherein at least one of the rotations of the planar substrate includes a translation and a rotation of the planar substrate.

8. The method of claim 7, wherein the translation of the planar substrate involves feeding the planar substrate between the front carriage and the rear carriage.

9. A method for applying a spacer to a planar substrate, comprising:

a. unwinding a length of spacer material from a spool of spacer material;

b. straightening the length of spacer material that has been unwound from the spool;

c. defining a first notch, a second notch, and a third notch in the length of spacer material;

d. separating the length of spacer material from a remainder of the spacer material on the spool to form the spacer that has a first end and a second end;

e. applying an adhesive to a first side and a second side of the spacer;

f. translating the spacer in a longitudinal direction;

g. aligning the first end of the spacer with a first corner of the planar substrate;

h. feeding a first portion of the spacer and a first portion of the planar substrate between a front carriage and a rear carriage along a longitudinal axis of an unadhered portion of the spacer while pressing the first portion of the spacer against the first portion of the planar substrate to adhere the first portion of the spacer to the first portion of the planar substrate to result in a first adhered portion of the spacer, wherein the first portion of the spacer comprises the portion of the spacer between the first end of the spacer and the first notch and the first portion of the planar substrate comprises the portion of the planar substrate between the first corner and the second corner;

i. rotating, with a six-axis robot, the planar substrate and the first adhered portion of the spacer 90° to bend the spacer at the first notch, wherein the first notch is aligned with the second corner of the planar substrate;

j. feeding a second portion of the spacer and a second portion of the planar substrate between the front carriage and the rear carriage along the longitudinal axis of the unadhered portion of the spacer while pressing the second portion of the spacer against the second portion of the planar substrate to adhere the second portion of the spacer to the second portion of the planar substrate to result in a second adhered portion of the spacer, wherein the second portion of the spacer comprises the portion of the spacer between the first notch and the second notch and the second portion of the planar substrate comprises the portion of the planar substrate between the second corner and the third corner;

k. rotating, with the six-axis robot, the planar substrate, the first adhered portion of the spacer, and the second adhered portion of the spacer 90° to bend the spacer at the second notch, wherein the second notch is aligned with the third corner of the planar substrate;

l. feeding a third portion of the spacer and a third portion of the planar substrate between the front carriage and the rear carriage along the longitudinal axis of the unadhered portion of the spacer while pressing the third portion of the spacer against the third portion of the planar substrate to adhere the third portion of the spacer to the third portion of the planar substrate to result in a third adhered portion of the spacer, wherein the third portion of the spacer comprises the portion of the spacer between the second notch and the third notch and the third portion of the planar substrate comprises the portion of the planar substrate between the third corner and a fourth corner;

m. rotating, with the six-axis robot, the planar substrate, the first adhered portion of the spacer, the second adhered portion of the spacer, and the third adhered portion of the spacer 90° to bend the spacer at the third notch, wherein the third notch is aligned with the fourth corner of the planar substrate; and n. feeding a fourth portion of the spacer and a fourth portion of the planar substrate between the front carriage and the rear carriage along the longitudinal axis of the unadhered portion of the spacer while pressing the fourth portion of the spacer against the fourth portion of the planar substrate to adhere the fourth portion of the spacer to the fourth portion of the planar substrate to result in a fourth adhered portion of the spacer, wherein the fourth portion of the spacer comprises the portion of the spacer between the third notch and a second end of the spacer and the fourth portion of the planar substrate comprises the portion of the planar substrate between the fourth corner and the first corner.

* * * * *